US008011659B2

(12) United States Patent
Tabata

(10) Patent No.: US 8,011,659 B2
(45) Date of Patent: Sep. 6, 2011

(54) SHEET TRANSPORT DIRECTION SWITCHING DEVICE, AND IMAGE FORMING APPARATUS INCORPORATED WITH THE SAME

(75) Inventor: Fujio Tabata, Osaka (JP)

(73) Assignee: Kyocera Mita Corporation (JP)

( * ) Notice: Subject to any disclaimer, the term of this patent is extended or adjusted under 35 U.S.C. 154(b) by 294 days.

(21) Appl. No.: 12/423,526

(22) Filed: Apr. 14, 2009

(65) Prior Publication Data

US 2009/0267291 A1 Oct. 29, 2009

(30) Foreign Application Priority Data

Apr. 23, 2008 (JP) ..... 2008-112693

(51) Int. Cl.
*B65H 39/10* (2006.01)

(52) U.S. Cl. ..... 271/303; 271/185; 271/265.04

(58) Field of Classification Search ..... 271/303, 271/304, 225, 265.04, 176, 185
See application file for complete search history.

(56) References Cited

U.S. PATENT DOCUMENTS 3,955,812 A * 5/1976 Suda et al. ..... 271/303
5,868,387 A 2/1999 Kida et al.
6,390,464 B1 * 5/2002 Gutierrez et al. ..... 271/303
7,887,054 B2 * 2/2011 Daigo et al. ..... 271/303

FOREIGN PATENT DOCUMENTS

JP 9-86759 3/1997
JP 2006199452 A * 8/2006

* cited by examiner

*Primary Examiner* — Gerald McClain
(74) *Attorney, Agent, or Firm* — Gerald E. Hespos; Michael J. Porco

(57) ABSTRACT

A sheet transport switching device include a rotary guide that is pivotal about an axis orthogonal to a sheet transport direction to align a guide passage with one of two discharge destinations. A stepping motor changes the posture of the rotary guide and a controller controls the stepping motor. A lead end in-timing acquirer acquires a timing when a lead end of the sheet enters the guide passage. The controller performs, in a state that the exit of the guide passage aligns with one of the two discharge destinations, an in-timing retaining operation of retaining a rotated position of the stepping motor by supplying an energizing current of a first current value to the stepping motor at the acquired lead end in-timing, and a pass timing retaining operation of reducing the energizing current to a second value when the lead end of the sheet passes the guide passage.

18 Claims, 13 Drawing Sheets

SHEET TRANSPORT DIRECTION SWITCHING DEVICE, AND IMAGE FORMING APPARATUS INCORPORATED WITH THE SAME

BACKGROUND OF THE INVENTION

1. Field of the Invention

The present invention relates to a sheet transport direction switching device for switching a transport direction of a sheet to be transported, and an image forming apparatus incorporated with the sheet transport direction switching device.

2. Description of the Related Art

Conventionally, there is known a sheet transport direction switching device (e.g. a sheet transporting and treating device in JP Hei 9-86759A) for use in a sheet transport system in an image forming apparatus, as recited in JP Hei 9-86759A. The sheet transport direction switching device is constructed in such a manner that after an image forming operation is performed by an image forming apparatus, a discharge destination of a sheet carrying a toner image on a surface thereof is switched over between a discharge tray, and a switchback path for a double-side printing operation, wherein a rotary guide member (corresponding to a switching gate in JP Hei 9-86759A) is provided at a branching position of the two destinations.

The rotary guide member is constructed in such a manner that four guide plates are mounted between a pair of circular side plates disposed opposite to each other with a distance slightly larger than a sheet width, and that rotating shafts extend in directions opposite to each other from center positions of the circular side plates, respectively.

Three guide passages i.e. a middle straightforward guide passage, and two inverse guide passages defined at both sides of the middle straightforward guide passage are defined between each opposing pair of the guide plates. A sheet transported toward the rotary guide member is selectively passed through one of the guide passages depending on a rotated amount of the rotary guide member with respect to a reference phase thereof. Thereby, the sheet is discharged to a predetermined destination.

The rotary guide member is integrally rotated about an axis of rotation thereof by a stepping motor which is drivingly rotated depending on the number of pulses of a pulse signal. With this arrangement, the position of the rotary guide member is defined, in other words, a discharge destination of a sheet transported to the rotary guide member is determined.

A stepping motor is constructed in such a manner that a so-called detent torque i.e. a retention torque for fixedly holding the stepping motor at a rotated position thereof is generated by bringing the stepping motor to a non-energizing state by setting a current flowing through a coil of the stepping motor to zero. Bringing the stepping motor to a non-energizing state after the rotary guide member is fixed at a predetermined rotated position by the stepping motor enables to fixedly position the rotary guide member by a detent torque.

The rotary guide member is operable to bend a sheet transport direction by abutment of a lead end of a sheet transported to the rotary guide member against a guide plate constituting a guide passage at an entrance of the rotary guide member. In this arrangement, a rotation torque larger than a detent torque may be generated when a sheet is abutted against the guide plate, with the result that the rotary guide member may be rotated, and proper sheet transport may be obstructed.

SUMMARY OF THE INVENTION

In view of the above, it is an object of the present invention to provide a sheet transport direction switching device that enables to suppress rotation of a rotary guide member by a rotation torque resulting from abutment of a sheet against a sheet passage, and an image forming apparatus incorporated with the sheet transport direction switching device.

A sheet transport direction switching device according to an aspect of the invention includes: a rotary guide member having a guide passage for passing a sheet to be transported, and pivotally movable about an axis of a support shaft extending in a direction orthogonal to a sheet transport direction to such a posture as to align an exit of the guide passage with at least one of two discharge destinations; a stepping motor for changing the posture of the rotary guide member; a motor controller for controlling a rotation of the stepping motor by supplying an energizing current through a coil to the stepping motor; and a lead end in-timing acquirer for acquiring a timing when a lead end of the sheet enters an entrance of the guide passage. The motor controller is operable to perform, in a state that the exit of the guide passage is aligned with at least one of the two discharge destinations, an in-timing retaining operation of retaining a rotated position of the stepping motor by supplying an energizing current of a first current value to the stepping motor at the timing, acquired by the lead end in-timing acquirer, when the lead end of the sheet enters the entrance of the guide passage, and a pass timing retaining operation of reducing the energizing current to a second current value smaller than the first current value when the lead end of the sheet passes the guide passage.

In the above arrangement, the lead end in-timing acquirer is operable to acquire a timing when a lead end of a sheet enters the entrance of the guide passage, and a rotation torque may be exerted to the rotary guide member by abutment of the sheet against the guide passage. Then, the motor controller is operable to perform an in-timing retaining operation of retaining a rotated position of the stepping motor by supplying an energizing current of the first current value to the stepping motor at the timing when the lead end of the sheet enters the entrance of the guide passage. Thereby, the retention force of the stepping motor becomes larger than the detent torque of the stepping motor. This is advantageous in suppressing rotation of the rotary guide member by a rotation torque resulting from abutment of a sheet against the guide passage. In this condition, if supply of an energizing current to the stepping motor in a suspended state of the stepping motor is continued, the stepping motor may be heated. Also, a rotation torque to be exerted to the rotary guide member is reduced, when a lead end of a sheet passes the guide passage. In view of this, the motor controller is operable to perform a pass timing retaining operation of reducing an energizing current to the second current value smaller than the first current value when the lead end of the sheet passes the guide passage. This is advantageous in reducing an energizing current to be supplied to the stepping motor, and suppressing heating of the stepping motor.

An image forming apparatus according to another aspect of the invention includes the aforementioned sheet transport direction switching device, and an image forming section for forming an image on the sheet based on predetermined image data.

The image forming apparatus having the above arrangement is advantageous in suppressing rotation of the rotary guide member provided in the sheet transport direction switching device for use in image formation by a rotation torque resulting from abutment against a sheet.

These and other objects, features and advantages of the present invention will become more apparent upon reading the following detailed description along with the accompanying drawings.

BRIEF DESCRIPTION OF THE DRAWINGS

FIGS. 6A and 6B are front sectional views for describing sheet guide postures of a rotary guide member, wherein FIG. 6A shows a state that the rotary guide member is set to a reference posture, and FIG. 6B shows a state that the rotary guide member is set to an upright posture.

FIGS. 7A and 7B are front sectional views for describing sheet guide postures of the rotary guide member, wherein FIG. 7A shows a state that the rotary guide member is set to an internal discharge tray oriented posture, and FIG. 7B shows a state that the rotary guide member is set to an inversion path oriented posture.

DETAILED DESCRIPTION OF THE PREFERRED EMBODIMENTS

Figure 1:
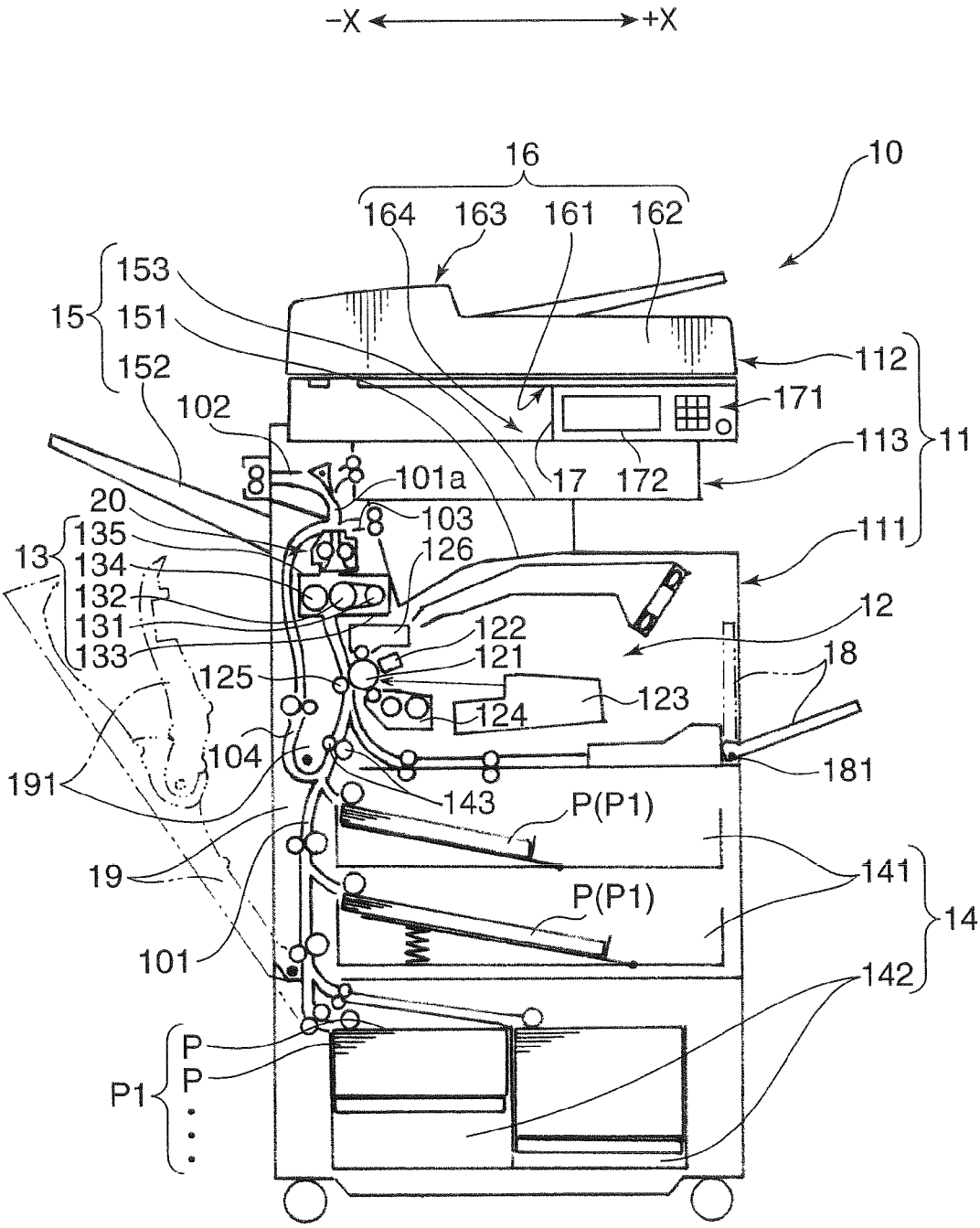
FIG. 1 is a front elevational view of an image forming apparatus to which a sheet transport direction switching device embodying the invention is applied, for briefly describing an arrangement of the image forming apparatus.
Figure 2:
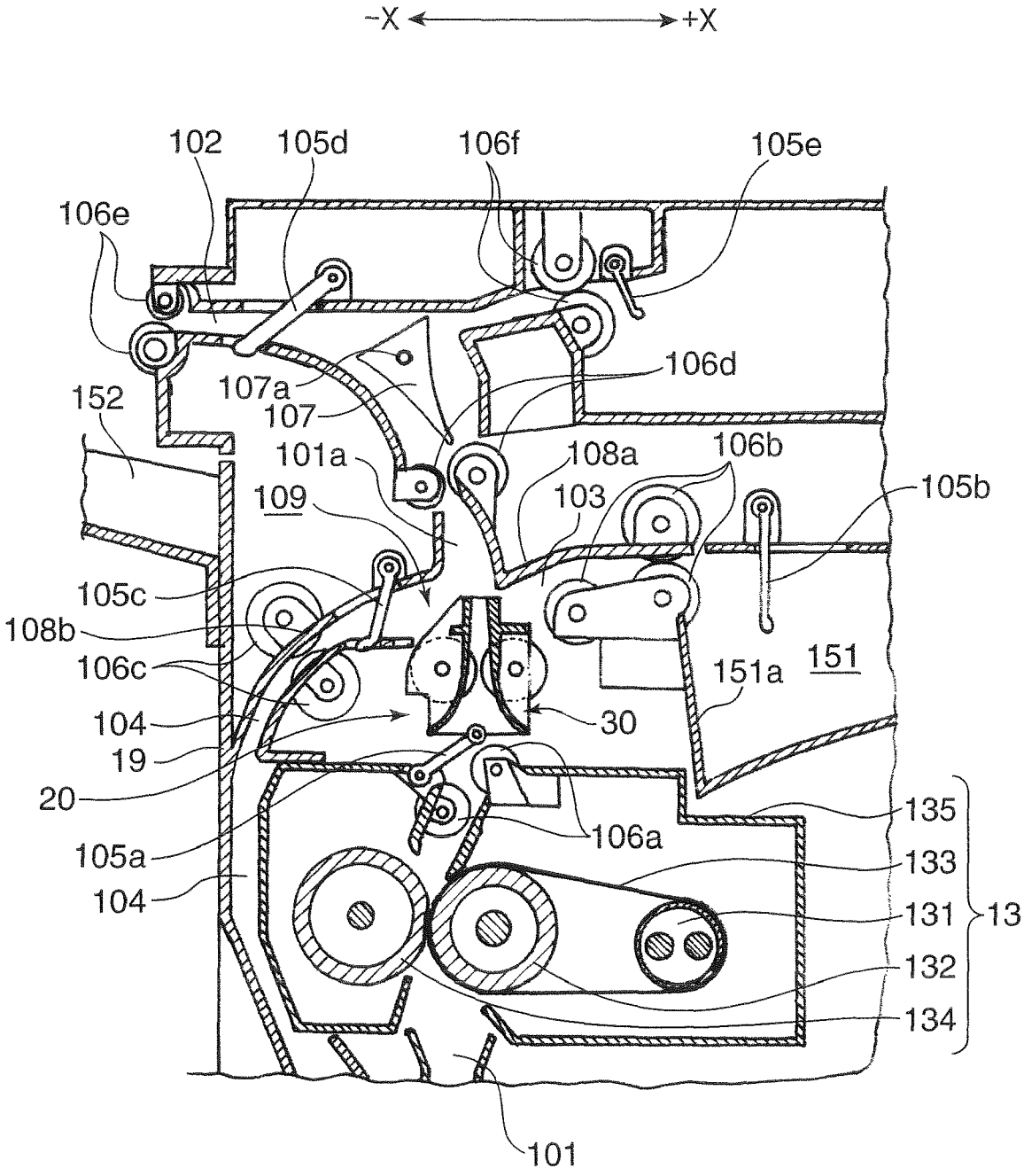
FIG. 2 is an enlarged view showing a mechanism portion of the sheet transport direction switching device provided in an apparatus body of the image forming apparatus shown in FIG. 1.

In the following, an embodiment of the invention is described referring to the drawings. Elements having like reference numerals throughout the drawings have like arrangements, and repeated description thereof is omitted herein. FIG. 1 is a front elevational view of an image forming apparatus 10 to which a sheet transport direction switching device 20 embodying the invention is applied, for briefly describing an arrangement of the image forming apparatus 10. FIG. 2 is an enlarged view showing a mechanism portion of the sheet transport direction switching device 20 shown in FIG. 1, specifically, a sheet transport direction switching section 109 and peripheral parts thereof. The sheet transport direction switching section 109 is provided in an apparatus body 11 of the image forming apparatus 10. In FIGS. 1 and 2, X-X directions are called as leftward and rightward directions, and particularly, −X direction is called as a leftward direction, and +X direction is called as a rightward direction.

The image forming apparatus 10 shown in FIG. 1 is a copying machine of a so-called internal discharge type. An image forming section 12, a fixing section 13, a sheet storing section 14, a sheet discharging section 15, an image reading section 16, and an operating section 17 are provided in the interior of the apparatus body 11. A part (i.e. an internal discharge tray 151 to be described later) of the sheet discharging section 15 is defined by inwardly bending a part of the apparatus body 11 at a position beneath the image reading section 16. In this sense, the image forming apparatus 10 is called as an apparatus of an internal discharge type.

The apparatus body 11 includes a rectangular parallelepiped lower body portion 111, a flat rectangular parallelepiped upper body portion 112 formed above the lower body portion 111 and opposite thereto, and a connecting portion 113 formed between the upper body portion 112 and the lower body portion 111. The connecting portion 113 is a structural member for connecting the lower body portion 111 and the upper body portion 112 in a state that the internal discharge tray 151 of the sheet discharging section 15 is defined between the lower body portion 111 and the upper body portion 112.

The image forming section 12, the fixing section 13, and the sheet storing section 14 are provided in the interior of the lower body portion 111. The image reading section 16 is mounted at the upper body portion 112. The operating section 17 is provided at a front end of the upper body portion 112.

The operating section 17 is operable to accept an operation input concerning an image forming operation. The operating section 17 includes an operation key section 171 such as a ten key for allowing an operator to input the number of sheets P for image formation and the like, and various operation keys; and a touch panel 172 equipped with an LCD (Liquid Crystal Display) for allowing the operator to input by touching.

The operating section 17 is operable to accept sheet type information as elasticity information. The sheet type information is information relating to an elasticity of a sheet P as to whether the sheet P stored in a sheet accommodating section such as the sheet storing section 14 or a manual tray 18 is an ordinary sheet, a thick sheet, or a transparent resin sheet for use in an OHP (Overhead Projector). In this embodiment, the operating section 17 corresponds to an example of an elasticity information acquirer. Hereinafter, description is made based on a premise that a sheet P includes a sheet member other than paper e.g. an OHP sheet.

The sheet storing section 14 includes sheet cassettes 141 detachably mounted in the lower body portion 111 at a position directly below the image forming section 12; and large capacity decks 142, detachably mounted in the lower body portion 111 at a position below the sheet cassettes 141, for storing a large number of sheets P. In this embodiment, two sheet cassettes 141 are provided one over the other, and two large capacity decks 142 are provided side by side.

When an image forming operation is performed, a sheet P of a sheet stack P1 is dispensed from one of the sheet cassettes 141 and the large capacity decks 142, and fed to the image forming section 12. The sheet P fed to the image forming section 12 is subjected to an image forming operation i.e. a printing operation.

The sheet discharging section 15 includes the internal discharge tray (switchback tray) 151 formed between the lower body portion 111 and the upper body portion 112, an external discharge tray (external tray) 152 formed on an exterior of the apparatus body 11, and an internal sheet finisher 153 provided at a position directly above the internal discharge tray 151. A sheet P subjected to a toner image transferring operation in the image forming section 12 is selectively transported to a predetermined discharge destination i.e. one of the internal discharge tray 151, the external discharge tray 152, and the internal sheet finisher 153 via the sheet transport direction switching section 109 defined in the interior of the connecting portion 113. The internal sheet finisher 153 is operable to perform a post-processing operation such as punching or stapling on sheets P discharged to the internal sheet finisher 153.

The internal discharge tray 151 is not only used as a tray for discharging a sheet P, but also used as a switchback tray for turning a sheet P upside down so as to print an image on the other side of a sheet P after an image is printed on one side of the sheet P in performing a double-side printing operation. Specifically, after an image is printed on one side of a sheet P, the sheet P is temporarily discharged to the internal discharge tray 151, is switched back in a state that a trail end of the sheet P in the one-side printing operation serves as a lead end of the sheet P in an operation of printing an image on the other side of the sheet P, and is fed back to the image forming section 12. Then, the sheet P carrying an image on one side thereof has an image printed on the other side thereof in the image forming section 12, and is discharged to the internal discharge tray 151 or the external discharge tray 152.

The image reading section 16 includes a contact glass platen 161, mounted in an opening in a top wall of the upper body portion 112, for placing a document; an openable/closable document cover 162 for firmly holding the document placed on the contact glass platen 161; an automatic document reader 163 mounted on the document cover 162; and a scan mechanism 164 for scanning an image of the document placed on the contact glass platen 161.

An image of a document placed on the contact glass platen 161, or fed to the contact glass platen 161 by the automatic document reader 163 is read by the scan mechanism 164 as analog information. Thereafter, the analog information is converted into a digital signal. The digital signal is outputted to an exposure unit 123, to be described later, for an image forming operation.

The manual tray 18 is mounted on a right wall of the lower body portion 111 at a position directly above the sheet storing section 14. The manual tray 18 is constructed in such a manner that a lower part thereof is pivotally movable about an axis of a support shaft 181 between a closing posture where the manual tray 18 stands upright to close a manual sheet feeding port of the image forming apparatus 10, and an opening posture where the manual tray 18 extends in rightward direction. When the manual tray 18 is set at the opening posture, sheets P placed on the manual tray 18 are manually fed one by one. The sheets P manually fed from the manual tray 18 are successively fed toward a nip portion between a photosensitive drum 121 and a transfer roller 125, which are described later, along a vertical transport path 101.

An openable/closable maintenance door 19 for maintenance service is mounted on a left wall of the lower body portion 111. The external discharge tray 152 is mounted at a position above the maintenance door 19. A sheet P subjected to a printing operation in the image forming section 12 is selectively discharged onto one of the external discharge tray 152 and the internal discharge tray 151.

The photosensitive drum 121 is provided at a substantially middle position in vertical direction and at a slightly left position in the image forming section 12. A surface of the photosensitive drum 121 is uniformly charged by a charging unit 122 mounted at a position immediately to the right of the photosensitive drum 121, while the photosensitive drum 121 is rotated clockwise about an axis of rotation thereof.

The exposure unit 123 is provided at a position to the right of the photosensitive drum 121 to emit a laser beam to the surface of the photosensitive drum 121, based on image information relating to a document image read by the image reading section 16. An electrostatic latent image is formed on the surface of the photosensitive drum 121 by emission of the laser beam from the exposure unit 123. A toner is supplied to the electrostatic latent image from a developing unit 124 provided below the photosensitive drum 121. Thereby, a toner image based on the electrostatic latent image is formed on the surface of the photosensitive drum 121.

A sheet P transported from one of the sheet cassettes 141 and the large capacity decks 142 is guided upwardly along the vertical transport path 101, and transported to the photosensitive drum 121 carrying a toner image on the surface thereof in synchronism with a rotation of a registration roller pair 143. Then, the toner image on the surface of the photosensitive drum 121 is transferred onto the sheet P by the transfer roller 125 disposed opposite to the photosensitive drum 121 on the left side thereof. Then, the sheet P carrying the transferred toner image is separated from the photosensitive drum 121, and fed to the fixing section 13.

After the toner image transferring operation on the sheet P is completed, the photosensitive drum 121 continues rotating clockwise. Thereby, the surface of the photosensitive drum 121 is subjected to a cleaning operation by a cleaning device 126 mounted at a position directly above the photosensitive drum 121. Thereafter, the photosensitive drum 121 faces the charging unit 122 for a succeeding image forming operation.

The fixing section 13 includes a heater roller 131 internally provided with an energizing heating element such as a halogen lamp; a fixing roller 132 disposed opposite to the heater roller 131 on the left side thereof; a fixing belt 133 wound around the fixing roller 132 and the heater roller 131; and a pressure roller 134 disposed opposite to the surface of the fixing belt 13 on the left side thereof. A sheet P transported from the image forming section 12 is subjected to a heating operation by the heater roller 131 via the fixing belt 133, while being transported through a nip portion between the fixing belt 133 and the pressure roller 134. Thereby, the sheet P carrying a transferred toner image is subjected to a fixing operation.

In the case where a one-side printing operation is performed, a sheet P after a fixing operation is discharged onto the external discharge tray 152 via the sheet transport direction switching section 109 defined above the fixing section 13 through a sheet discharge path 102, or onto the internal discharge tray 151 through a flip-flop path 103. In the case where a double-side printing operation is performed, after a sheet P is temporarily discharged onto the internal discharge tray 151 serving as a switchback tray through the flip-flop path 103, the sheet P is discharged onto the external discharge tray 152 or the internal discharge tray 151.

Specifically, in the case where a double-side printing operation is performed, after a first half of a sheet P subjected to a one-side printing operation is temporarily discharged onto the internal discharge tray 151 through the flip-flop path 103, the sheet P is fed backward through a vertically extending inversion path 104 in the interior of the maintenance door 19, and is fed to the image forming section 12 in a state that the surface of the sheet P is turned upside down for printing an image on the other side of the sheet P. The sheet P subjected to the double-side printing operation is discharged onto the internal discharge tray 151 or the external discharge tray 152.

The maintenance door 19 has a cover member 191 at a position immediately to the right of the inversion path 104, with a right wall of the cover member 191 facing a left wall of the image forming section 12. The cover member 191 is enclosed by a right wall of the maintenance door 19. When the maintenance door 19 is set at a closing posture, a part of the vertical transport path 101 for transporting a sheet P fed from one of the sheet cassettes 141, the large capacity decks 142, and the manual tray 18 is defined between the right wall of the cover member 191 and the left wall of the image forming section 12.

As shown in FIG. 2, the sheet transport direction switching section 109 is defined at a position directly above a casing 135 of the fixing section 13 and in a space to the left of a left wall 151*a* of the internal discharge tray 151. A downwardly concave first arc guide plate 108*a* is formed at an upper right position of the sheet transport direction switching section 109. The first arc guide plate 108*a* extends outwardly toward the internal discharge tray 151 with respect to an upper end of the left wall 151*a* of the internal discharge tray 151. A downwardly concave second arc guide plate 108*b* is formed at an upper left position of the sheet transport direction switching section 109. The second arc guide plate 180*b* defines a transport path on the left of the fixing section 13 to guide a sheet P to the inversion path 104 defined below the transport path.

A clearance is defined between a left end of the first arc guide plate 108*a* and a right end of the second arc guide plate 108*b* to receive a sheet P discharged upwardly from the fixing section 13. An upper end transport path 101*a* is defined in an upper region of the clearance, as a part of the upwardly extending vertical transport path 101.

A substantially isosceles triangular switching guide member 107 is mounted at a position directly above the upper end transport path 101*a*. The switching guide member 107 is operable to switch over a discharge destination of a sheet P through the upper end transport path 101*a* between the internal sheet finisher 153 and the external discharge tray 152. In an ordinary condition, the switching guide member 107 is mounted in such a manner that a portion of the switching guide member 107 corresponding to an apex of isosceles triangle is directed downward.

The switching guide member 107 is pivotally movable about an axis of a guide rod 107*a* at a substantially centroid position of the switching guide member 107 between a finisher oriented posture for guiding a sheet P toward the internal sheet finisher 153 along a right surface of the switching guide member 107 by clockwise pivotal movement, and an external discharge tray oriented posture for guiding a sheet P toward the external discharge tray 152 along a left surface of the switching guide member 107 by counterclockwise pivotal movement.

Specifically, after a sheet P subjected to an image forming operation in the image forming section 12, and a fixing operation in the fixing section 13 is temporarily guided to the sheet transport direction switching section 109, the sheet P is discharged to an intended destination depending on an intended image forming operation. The sheet transport direction switching section 109 has a rotary guide member 30, in place of a conventional triangular switching guide member.

Multiple transport rollers are provided in the vicinity of the rotary guide member 30 to smoothly guide a sheet P in and out of the rotary guide member 30. The transport rollers are: a fixing section exit roller pair 106*a* disposed at an exit of the fixing section 13 and at a position immediately in front of the rotary guide member 30 i.e. immediately below the rotary guide member 30; a first discharge roller pair 106*b* disposed at a lower position of the first arc guide plate 108*a* i.e. above the flip-flop path 103, and immediately in front of the internal discharge tray 151 for aiding discharge of a sheet P to the internal discharge tray 151; an inversion path oriented transport roller pair 106*c* disposed at a lower position of the second arc guide plate 108*b* for aiding transport of a sheet P toward the inversion path 104; a switching guide member oriented transport roller pair 106*d* disposed at a position immediately below the switching guide member 107 at a downstream end of the upper end transport path 101*a* for aiding transport of a sheet P toward the switching guide member 107; a second discharge roller pair 106*e* disposed at an upstream end of the external discharge tray 152; and a third discharge roller pair 106*f* disposed at an entrance of the internal sheet finisher 153.

Various sheet sensors are provided in the vicinity of the rotary guide member 30 to detect a transport status of a sheet P in and out of the rotary guide member 30. The sheet sensors are: a fixing upper sensor 105*a*, as a lead end in-timing acquirer and a trail end out-timing acquirer, disposed at a downstream end of the fixing section 13 i.e. at an upper position of the casing 135 of the fixing section 13; a first discharge sensor 105*b* disposed at an entrance of the internal discharge tray 151; an inversion sensor 105*c* disposed at an upstream end of the inversion path 104; a second discharge sensor 105*d* disposed near the second discharge roller pair 106*e* at an upstream end of the external discharge tray 152; and a third discharge sensor 105*e* disposed near the third discharge roller pair 106*f* at the entrance of the internal sheet finisher 153.

A sheet P transported from the fixing section 13 by detecting operations of the sheet P by the sensors 105*a*, 105*b*, 105*c*, 105*d*, 105*d*, and 105*e* and predetermined operations by the sheet transport direction switching section 109 and the switching guide member 107 based on the detection results of the sensors 105*a*, 105*b*, 105*c*, 105*d*, 105*d*, and 105*e*, is transported to a predetermined discharge destination.

Figure 3:
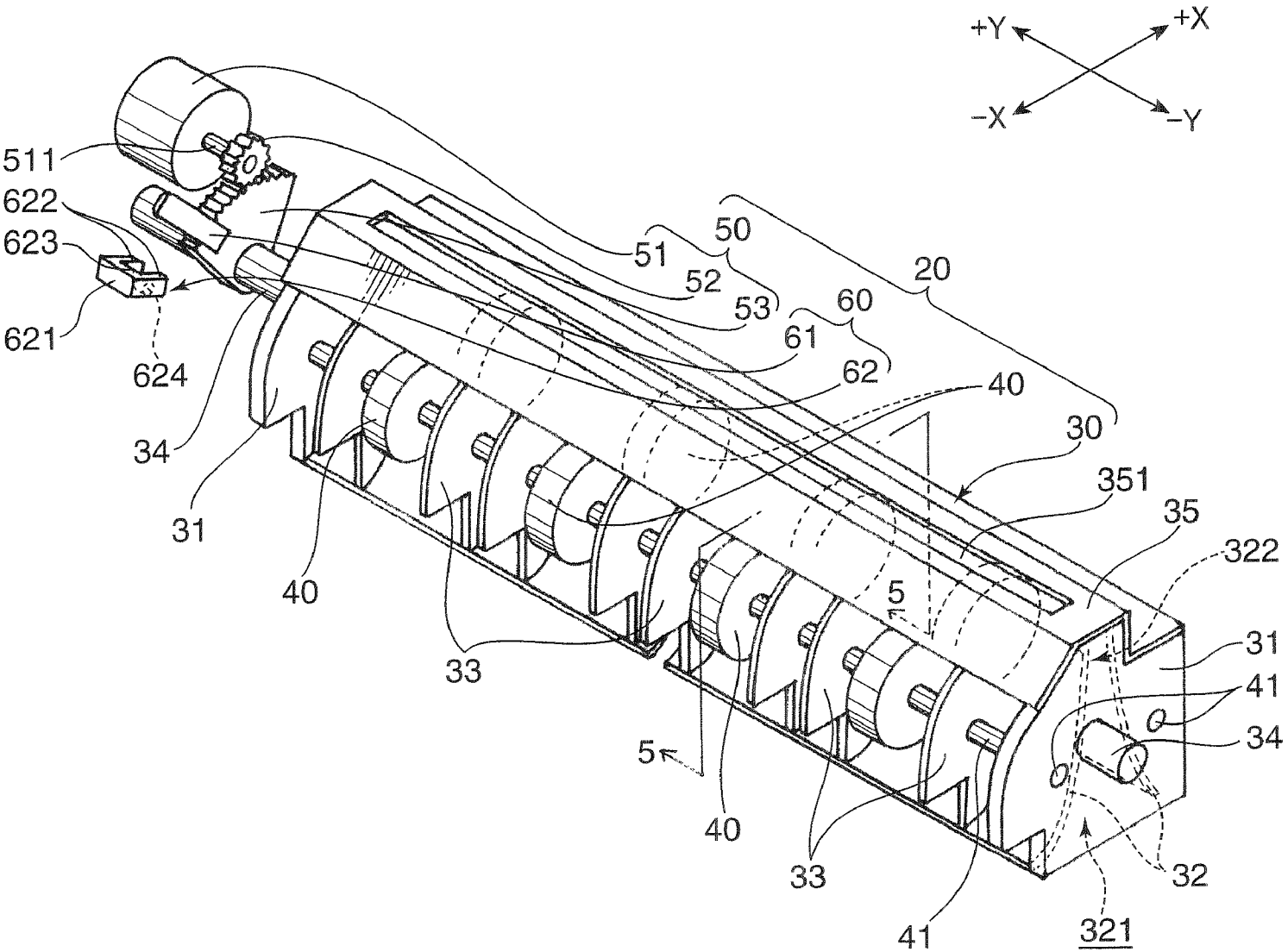
FIG. 3 is a partially cutaway perspective view of the sheet transport direction switching device shown in FIG. 2, viewed from obliquely above.
Figure 4:
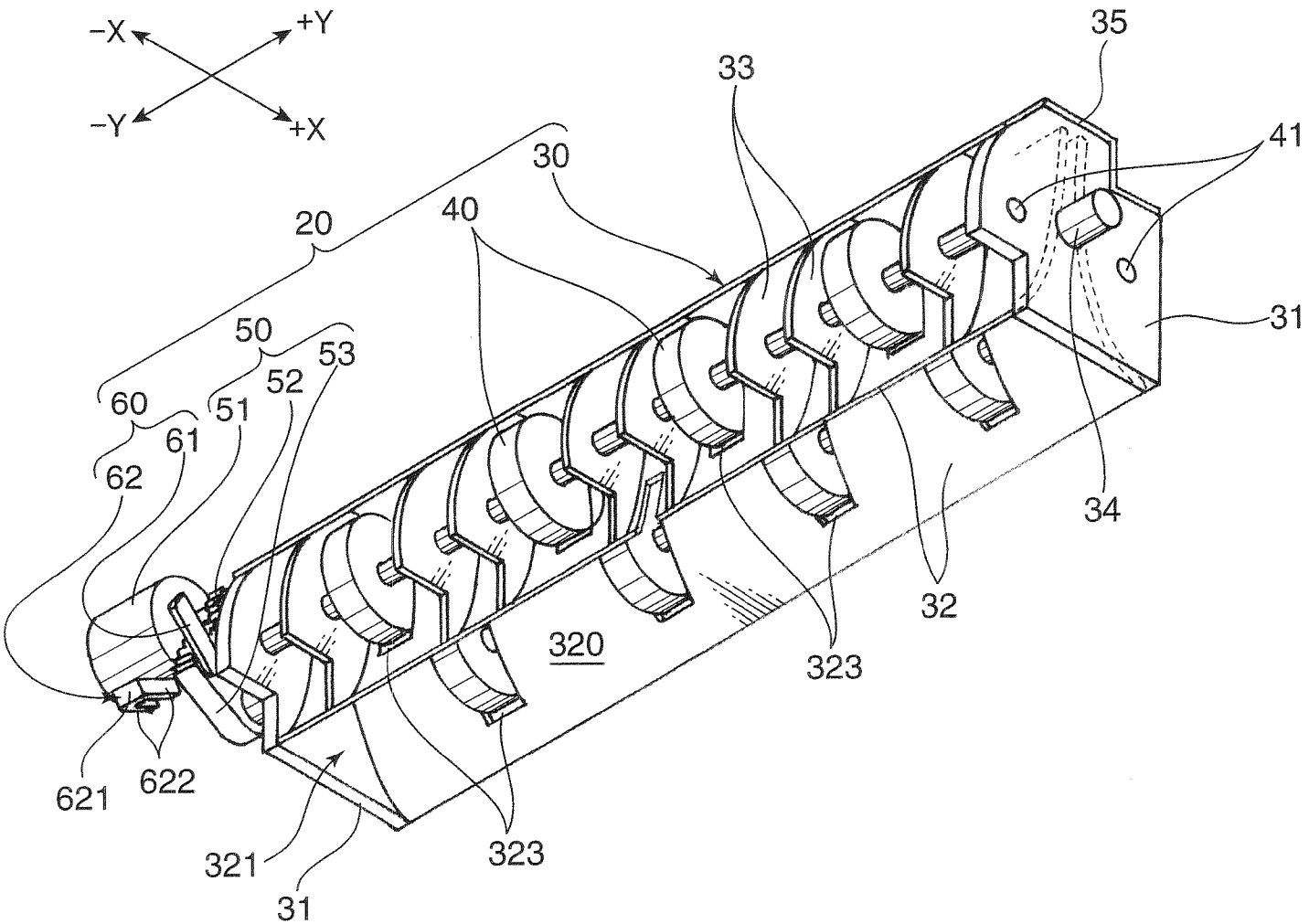
FIG. 4 is a perspective view of the sheet transport direction switching device shown in FIG. 3, viewed from obliquely below.
Figure 5:
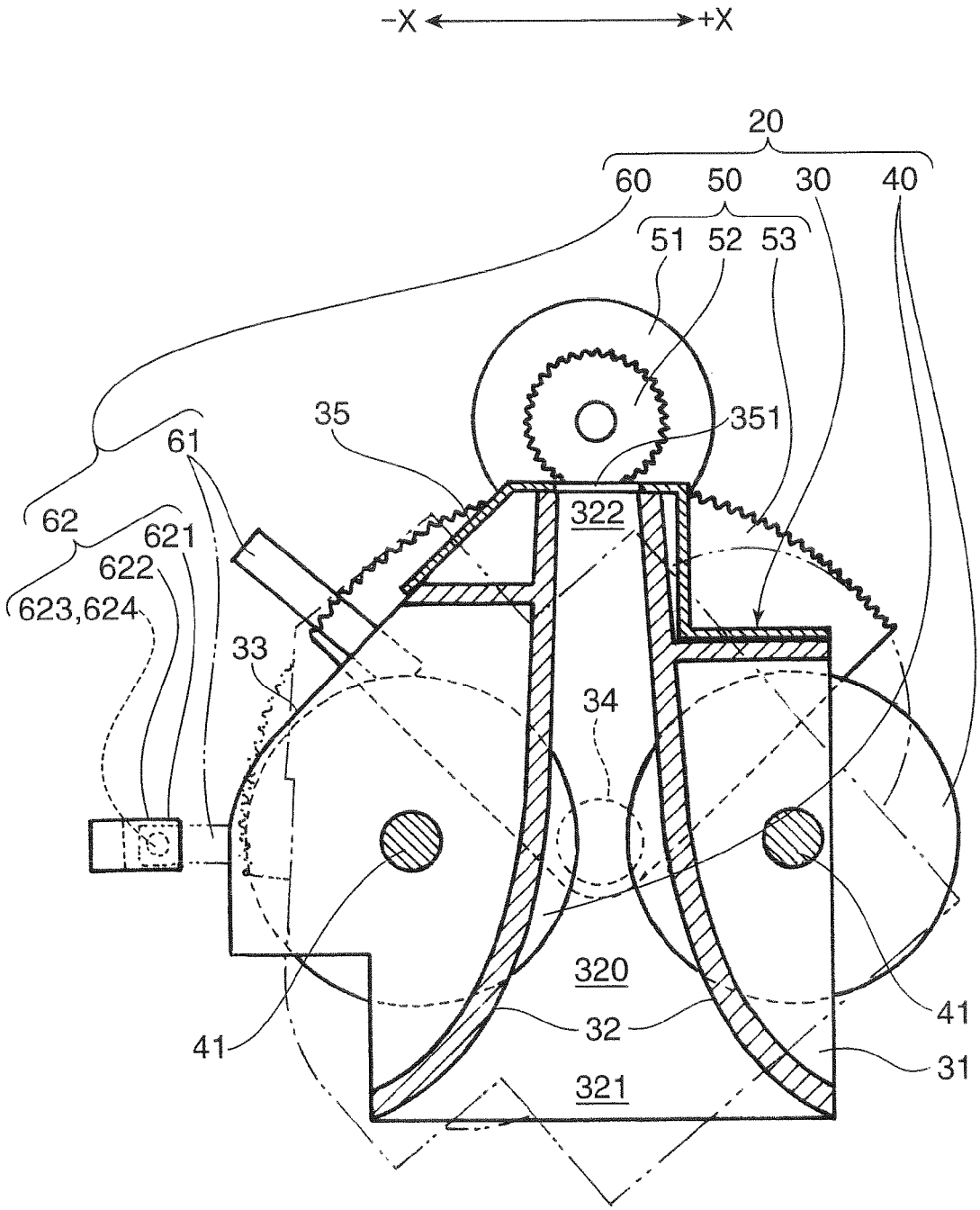
FIG. 5 is a cross-sectional view of the sheet transport direction switching device taken along the line 5-5 in FIG. 3.

In the following, the sheet transport direction switching section 109 is described referring to FIGS. 3 through 5. FIGS. 3 and 4 are partially cutaway perspective views showing an embodiment of the sheet transport direction switching section 109. FIG. 3 is a diagram viewed from obliquely above, and FIG. 4 is a diagram viewed from obliquely below. FIG. 5 is a cross-sectional view of the sheet transport direction switching section 109 taken along the line 5-5 in FIG. 3, wherein a member indicated by the two-dotted broken line is the rotary guide member 30 at a reference posture S1, and a member indicated by the solid line is the rotary guide member 30 at an upright posture S2. In FIGS. 3 through 5, X-X directions are called as leftward and rightward directions, and Y-Y directions are called as forward and backward directions. In particular, −X direction is called as a leftward direction, +X direction is called as a rightward direction, −Y direction is called as a forward direction, and +Y direction is called as a backward direction.

As shown in FIG. 3, the sheet transport direction switching section 109 includes: the rotary guide member 30 for receiving a sheet P transported from the fixing section 13 (see FIG. 2) by the fixing section exit roller pair 106*a* to guide and discharge the sheet P to a predetermined destination; guide pulleys 40, mounted in the rotary guide member 30, for guiding a sheet P without giving an adverse effect to a toner image on the sheet P; a posture changer 50 for changing the posture of the rotary guide member 30 by pivotally moving the rotary guide member 30 in forward or backward direction about axes of predetermined guide shafts (support shafts) 34; and a reference position detector 60 for detecting a reference angular position (hereinafter, called as a "reference posture") of the rotary guide member 30 whose posture is set by the posture changer 50.

The rotary guide member 30 includes a pair of side plates 31 disposed opposite to each other in forward and backward directions; a pair of arc guide plates 32 disposed opposite to each other in leftward and rightward directions between the side plates 31; multiple guide fins 33 fixed to the left arc guide plate 32 and arrayed in forward and backward directions; the paired guide shafts 34 coaxially extending in opposite directions from each other at substantially centroid positions of the front and rear side plates 31, respectively; and a cover member 35 mounted between upper ends of the paired side plates 31.

Each of the side plates 31 has a substantially square shape in front view, with some parts thereof being cutaway. The left and right arc guide plates 32 are mounted between the paired side plates 31. In this construction, the paired arc guide plates 32 serve as a structural member to impart a mechanical rigidity to the rotary guide member 30.

The paired arc guide plates 32 are bulged into an arc shape in front view in a state that opposing surfaces of the arc guide plates 32 face to each other. The paired arc guide plates 32 are formed in such a manner that the distance between lower ends thereof in leftward and rightward directions is gradually decreased in upward direction. A guide passage 320 for guiding a sheet P transported from the fixing section 13 is defined between the paired arc guide plates 32.

A receiving opening (entrance) 321 for receiving a sheet P guided from the fixing section 13 is defined between the lower ends of the paired arc guide plates 32. A discharge opening (exit) 322 for discharging a sheet P is defined between upper ends of the paired arc guide plates 32. A sheet P transported from the fixing section 13 is guided to a clearance between the paired arc guide plates 32 through the receiving opening 321 via the fixing upper sensor 105*a*, and discharged upwardly through a discharge port (exit) 351 defined by the discharge opening 322 and the cover member 35. A sheet P discharged through the discharge port 351 via the guide passage 320 in the rotary guide member 30 is guided to a predetermined destination depending on a posture of the rotary guide member 30, which is described later in detail.

The guide fins 33 are operable to guide a sheet P for printing an image on the other side of the sheet P in a double-side printing operation toward the inversion path 104, after the sheet P has been temporarily discharged on the internal discharge tray 151 in a state that the rotary guide member 30 is set at an inversion path oriented posture S4 (see FIG. 7B), which is described later. When the rotary guide member 30 is set at the inversion path oriented posture S4 (see FIG. 7B), upper ends of the guide fins 33 of an upwardly convex arc shape are aligned with the upper ends of the side plates 31. Thereby, an upstream end of the inversion path 104 is defined between the downwardly concave second arc guide plate 108*b* and the upper ends of the guide fins 33.

The paired guide shafts 34 coaxially extending in opposite directions from each other from the paired side plates 31 are supported on an unillustrated frame of the apparatus body 11, and integrally and pivotally moved in forward or backward direction along with the rotary guide member 30 about the axes of the guide shafts 34 by driving of the posture changer 50.

The cover member 35 is adapted to prevent intrusion of foreign matters such as dusts into the rotary guide member 30. As shown in FIG. 3, the cover member 35 covers an upper part of the rotary guide member 30, and extends between the upper ends of the paired side plates 31 in FIG. 3. The discharge port 351 (exit) extending in forward and backward directions for discharging a sheet P is defined in a top part of the cover member 35 at a position opposing to the discharge opening 322 defined by the paired arc guide plates 32.

Two arrays of the guide pulleys 40 are provided in forward and backward positions, with the left and right arc guide plates 32 being interposed therebetween. The two arrays of the guide pulleys 40 are rotatably supported about axes of a pair of left and right pulley shafts 41 mounted between the paired side plates 31 at left and right outer positions of the left and right paired arc guide plates 32, respectively. The left pulley shaft 41 extends through the guide fins 33.

As shown in FIG. 4, through windows 323 are formed in the left and right arc guide plates 32 at positions corresponding to the guide pulleys 40. Parts of the guide pulleys 40 are mounted in the guide passage 320 defined between the paired arc guide plates 32 through the through windows 323. Thereby, surfaces of the two arrays of the guide pulleys 40 oppose to each other in the guide passage 320.

In this arrangement, a sheet P transported from the fixing section 13 passes a clearance between the opposing surfaces of the left and right arrays of the guide pulleys 40 without abutment of an image forming surface of the sheet P against the paired arc guide plates 32, when the sheet P is guided along the clearance between the paired arc guide plates 32 through the receiving opening 321. In passing the clearance, even if the image forming surface of the sheet P is contacted with the surfaces of the guide pulleys 40, there is no likelihood that the image forming surface of the sheet P may be contacted with inner surfaces of the arc guide plates 32, because the guide pulleys 40 are rotated about the axes of the pulley shafts 41 by the contact. Thus, the arrangement is advantageous in effectively preventing an improper image formation by contact of the arc guide plates 32 with an image forming surface of a sheet P.

The posture changer 50 is operable to set the posture of the rotary guide member 30 based on a control signal from a controller 200, which is described later. The posture changer 50 includes a stepping motor 51, a drive gear 52 integrally and coaxially rotatably mounted on a drive shaft 511 about an axis of the drive shaft 511 of the stepping motor 51, and a section gear 53 integrally and pivotally fixed to the rear guide shaft 34 and in mesh with the drive gear 52.

The stepping motor 51 is constructed in such a manner that a rotation angle of the stepping motor 51 is determined depending on the number of pulses of a pulse signal. Accordingly, a rotation angle of the stepping motor 51 i.e. a posture of the rotary guide member 30 is precisely controlled by supplying a signal indicating a predetermined number of pulses depending on an intended image forming operation.

Unlike a conventional arrangement that a discharge destination is switched by e.g. changing a posture of a guide member by turning on and off an electric power supply to a solenoid, use of the stepping motor 51 having the above arrangement not only enables to precisely change a posture of a guide member but also avoids generation of abnormal sounds.

The stepping motor 51 is horizontally mounted at an upper rear position of the rotary guide member 30, with the drive shaft 511 being directed in forward direction. A driving force of the stepping motor 51 is transmitted to the rotary guide member 30 via the drive gear 52 and the section gear 53. In this arrangement, driving the stepping motor 51 in forward or backward direction enables to pivotally move the rotary guide member 30 about the axes of the guide shafts 34, thereby changing the posture of the rotary guide member 30.

The reference position detector 60 includes a light blocking member 61 radially and outwardly extending from the section gear 53, and a light sensor 62 disposed on a pivotal orbit of the light blocking member 61 about the axis of the rear guide shaft 34 in such a manner that the light sensor 62 opposes the light blocking member 61 when the rotary guide member 30 is set at the reference posture S1 (see FIG. 6A), as a home position.

The light sensor 62 is a so-called photointerruptor constructed in such a manner that a light emitting element 623 and a light receiving element 624 are respectively mounted on a pair of element support arms 622 of a two-legged support casing 621.

Specifically, the support casing 621 is positioned in such a manner that a part of the pivotal orbit of the light blocking member 61 is overlapped with the element support arms 622; and that the light blocking member 61 is interposed between the paired element support arms 622 when the rotary guide member 30 is set at the reference posture S1. The light emitting element 623 is mounted on one of the element support arms 622, and the light receiving element 624 is mounted on the other of the element support arms 622 as opposed to the light emitting element 623.

In this arrangement, in the case where the rotary guide member 30 is not set at the reference posture S1, light from the light emitting element 623 is received by the light receiving element 624. Thereby, the reference position detector 60 is operable to detect that the rotary guide member 30 is not set at the reference posture S1.

On the other hand, in the case where the rotary guide member 30 is set at the reference posture S1, the light blocking member 61 is interposed between the paired element support arms 622, and light from the light emitting element 623 is interrupted by the light blocking member 61, and the light receiving element 624 is turned off. Thereby, the reference position detector 60 is operable to detect that the rotary guide member 30 is set at the reference posture S1.

A rotated position of the stepping motor 51 when the light receiving element 624 is turned off is defined as a reference position, and energizing pulses are supplied to the stepping motor 51 upon detecting that a rotated position of the stepping motor 51 is aligned with the reference position. In this arrangement, the rotary guide member 30 can be set to an intended posture by rotating the stepping motor 51 by an intended rotation angle corresponding to the number of energizing pulses supplied to the stepping motor 51.

Figure 6A:
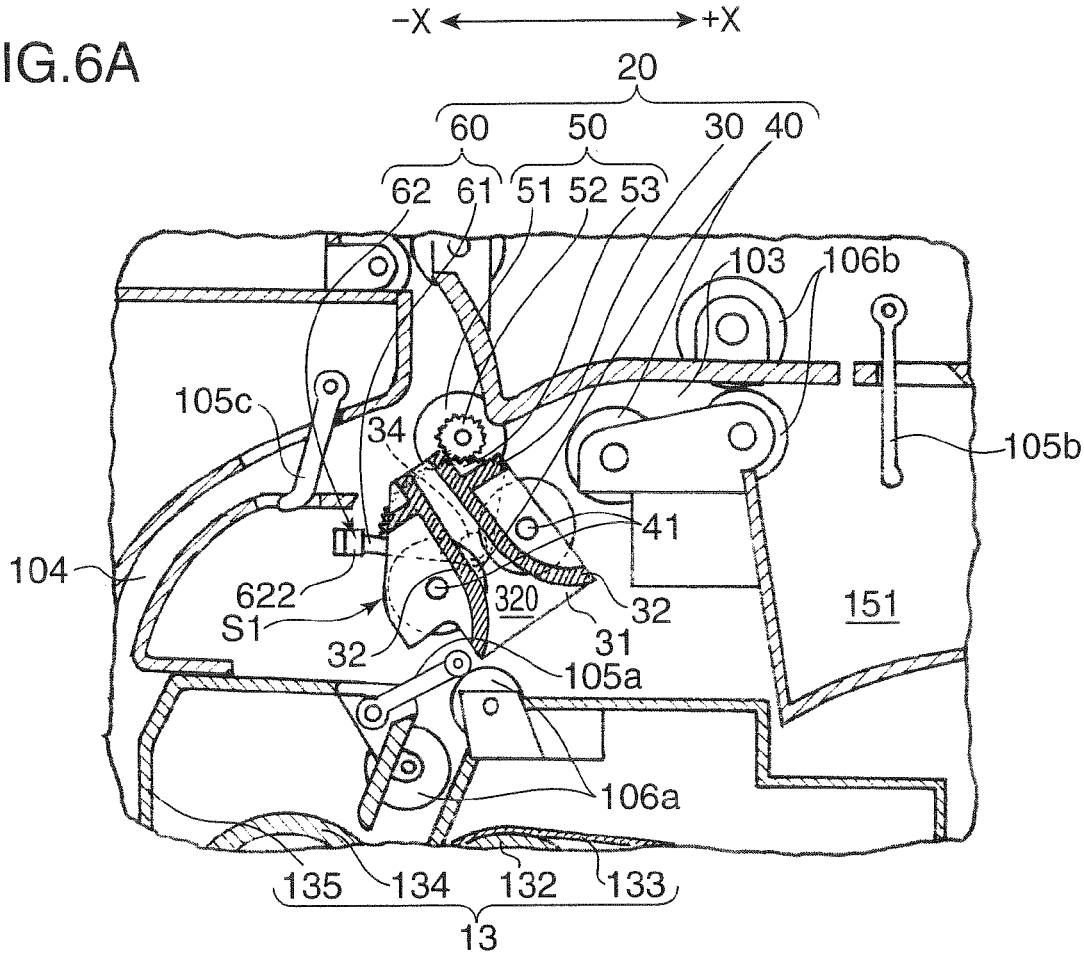
Figure 6B:
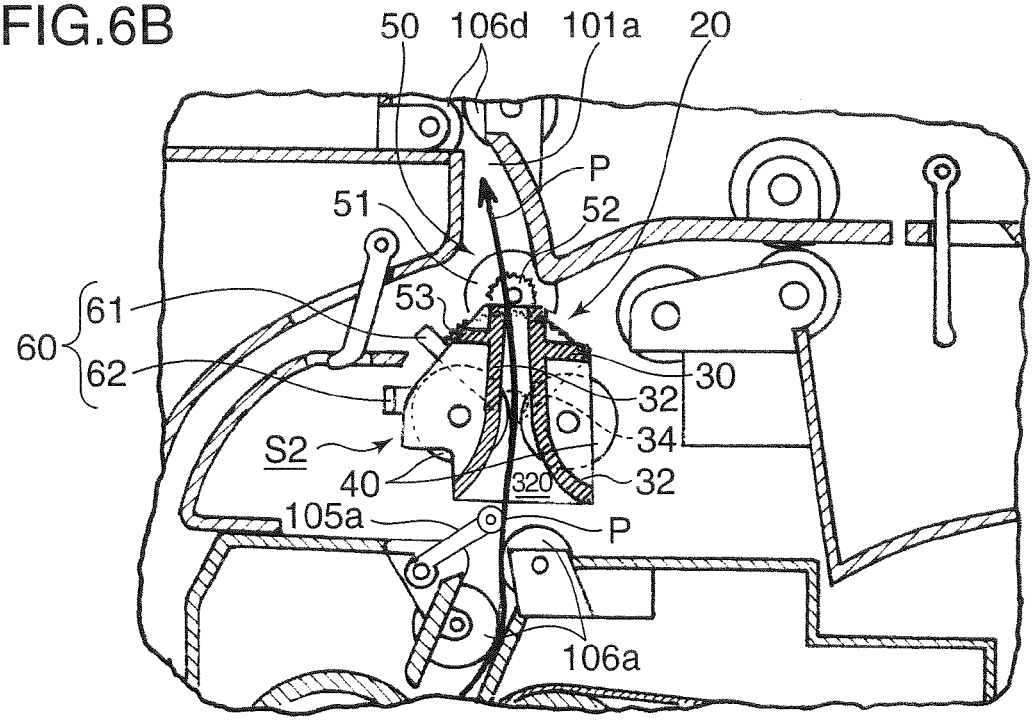

In the following, sheet guide postures of the rotary guide member 30 are described referring to FIGS. 6A through 7B. FIGS. 6A through 7B are front sectional views of the rotary guide member 30 for describing sheet guide postures of the rotary guide member 30. FIG. 6A shows a state that the rotary guide member 30 is set at the reference posture S1, and FIG. 6B shows a state that the rotary guide member 30 is set at the upright posture S2.

Figure 7A:
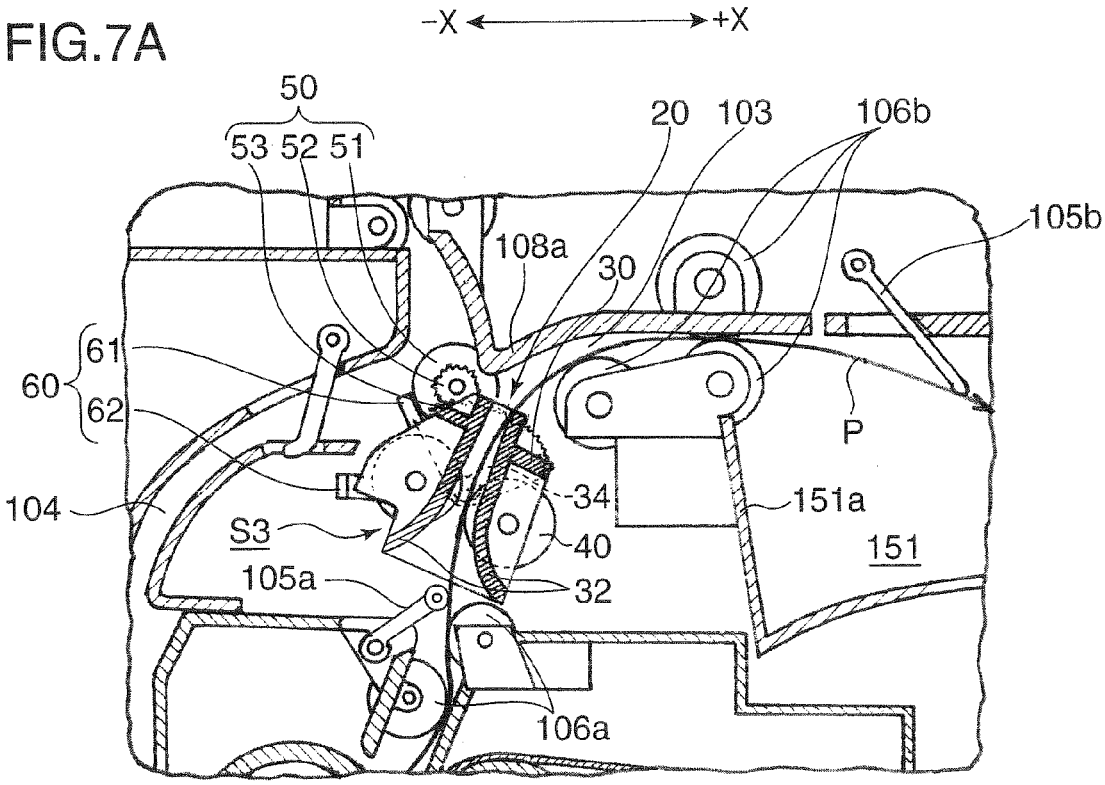
Figure 7B:
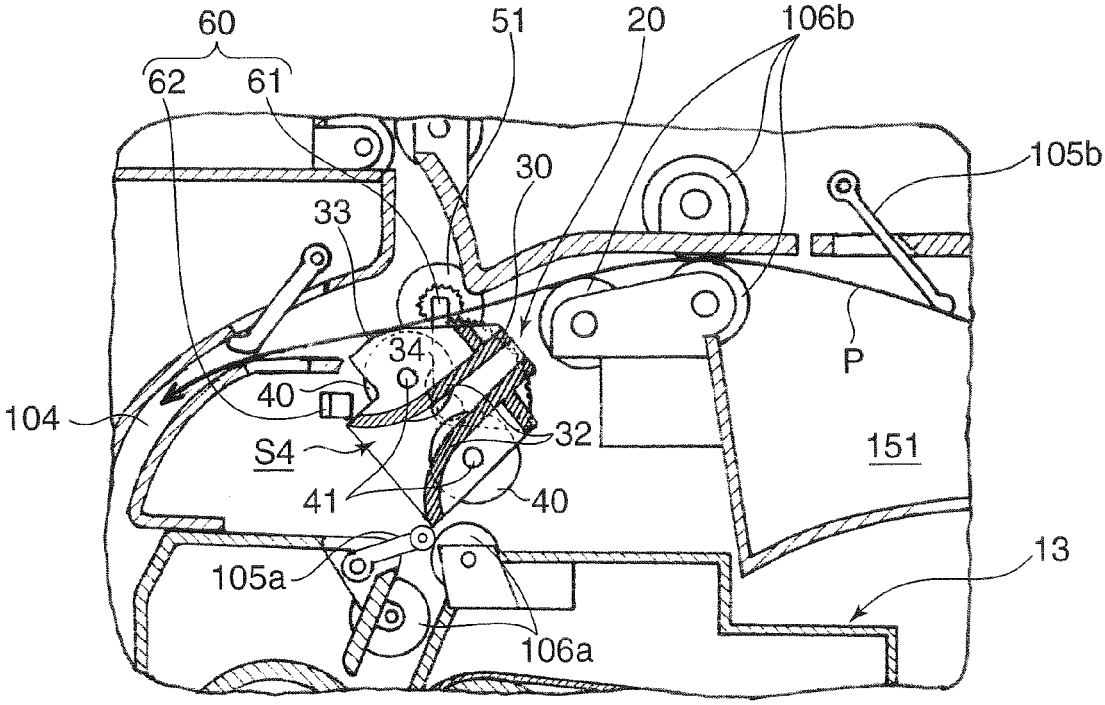

FIG. 7A shows a state that the rotary guide member 30 is set at an internal discharge tray oriented posture S3, and FIG. 7B shows a state that the rotary guide member 30 is set at an inversion path oriented posture S4. The direction indications with the symbol "X" in FIGS. 6A through 7B are the same as those in FIG. 1, wherein −X direction is called a leftward direction, and +X direction is called as a rightward direction.

As shown in FIG. 6A, when the rotary guide member 30 is set at the reference posture S1, the rotary guide member 30 is pivotally moved to such a position that the guide passage 320 defined between the paired arc guide plates 32 is displaced with respect to a vertical position by about 30° counterclockwise about the axes of the guide shafts 34. Thereby, the rotary guide member 30 is inclined in leftward direction.

In this state, the light blocking member 61 fixed to the section gear 53 is interposed between the paired element support arms 622 of the light sensor 62, thereby blocking incidence of light from the light emitting element 623 (see FIG. 3) onto the light receiving element 624. Thus, the reference position detector 60 is operable to detect the rotary guide member 30 at the reference posture S1, as well as the reference position of the stepping motor 51.

As shown in FIG. 6B, in the case where the rotary guide member 30 is set at the upright posture S2, the discharge port 351 is aligned with the upper end transport path 101*a*. When the rotary guide member 30 is set at the upright posture S2, a sheet P transported from the fixing section 13 is guided into the guide passage 320 of the rotary guide member 30 through the receiving opening 321 via the fixing upper sensor 105*a*, and discharged toward the upper end transport path 101*a* defined above the rotary guide member 30 through the discharge port 351 along a clearance between the two arrays of the guide pulleys 40.

Thereafter, the sheet P is directly discharged onto the external discharge tray 152; or discharged onto the external discharge tray 152 as a sheet bundle, after temporary discharge to the internal sheet finisher 153 for a post-processing operation such as stapling.

As shown in FIG. 7A, in the case where the rotary guide member 30 is set at the internal discharge tray oriented posture S3, the discharge port 351 is aligned with the discharge roller pair 106*b*. When the rotary guide member 30 is set at the internal discharge tray oriented posture S3, a sheet P transported from the fixing section 13 passes through the guide passage 320 in the rotary guide member 30, exits the discharge port 351, and is discharged onto the internal discharge tray 151, while being guided along the first arc guide plate 108*a*. The internal discharge tray oriented posture S3 is also used in performing a switchback operation for turning the surface of a sheet P upside down in performing a double-side printing operation.

As shown in FIG. 7B, in the case where the rotary guide member 30 is set at the inversion path oriented posture S4, the rotary guide member 30 is pivotally moved to such a position that the guide fins 33 are interposed between the first discharge roller pair 106 band the inversion path 104. Thereby, a sheet P fed backward from the internal discharge tray 151 by the first discharge roller pair 106*b* by a switchback operation in a double-side printing operation is transported to the inversion path 104 while being guided by the guide fins 33.

Figure 8:
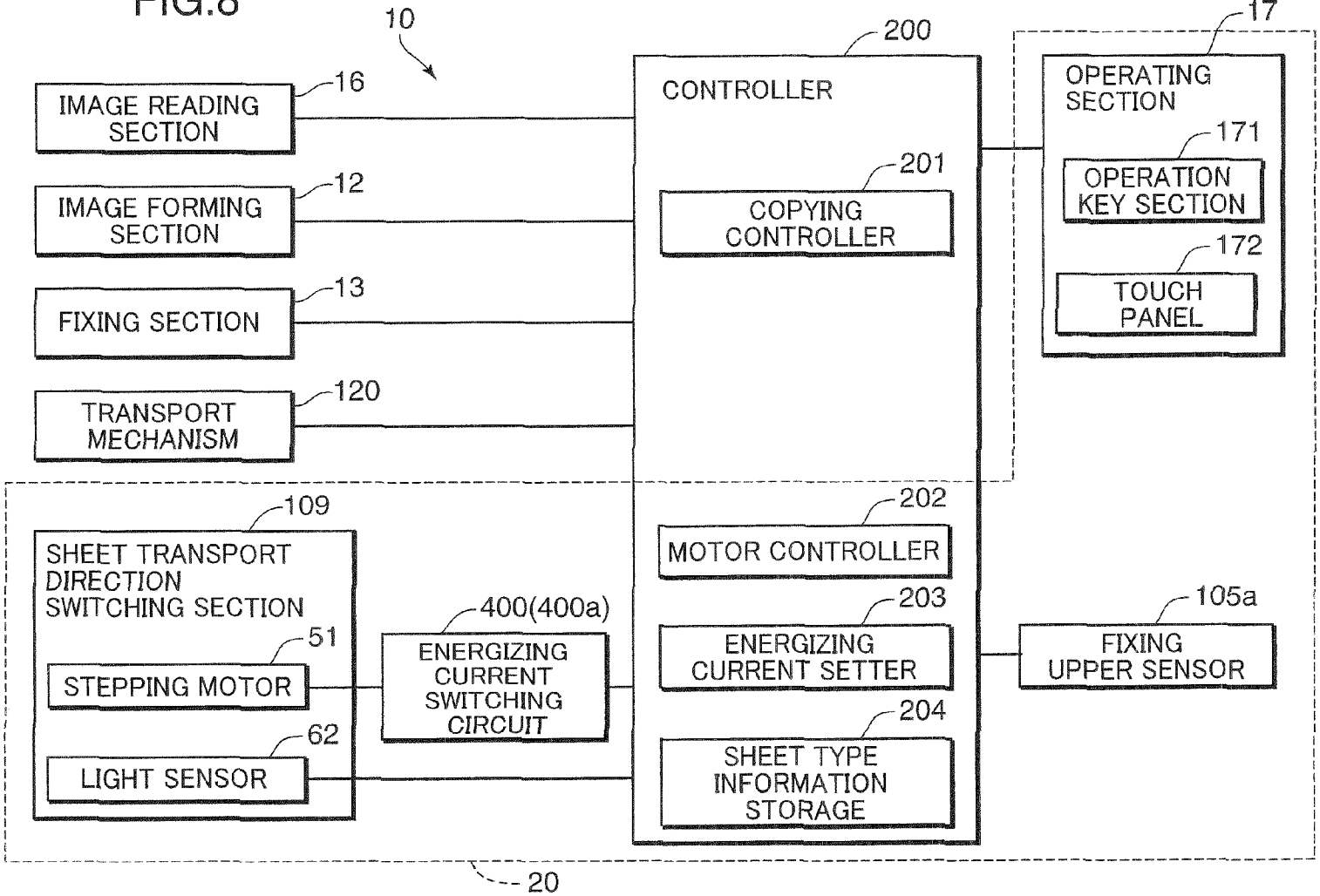
FIG. 8 is a block diagram showing an electrical configuration of the image forming apparatus shown in FIG. 1.

FIG. 8 is a block diagram showing an electrical configuration of the image forming apparatus 10 shown in FIG. 1. The image forming apparatus 10 includes the controller 200 and an energizing current switching circuit 400, in addition to the above mechanical portion. In FIG. 8, various rollers, switching guide members, and like elements for transporting a sheet P are recited as a transport mechanism 120.

The controller 200 is constituted of e.g. a CPU (Central Processing Unit) for implementing a predetermined computation, an ROM (Read Only Memory) storing a predetermined control program, an RAM (Random Access Memory) for temporarily storing data, a timer circuit, and peripheral circuits thereof. The controller 200 is connected to the image reading section 16, the image forming section 12, the fixing section 13, the transport mechanism 120, and the operating section 17.

The controller 200 is further connected to various sensors such as the light sensor 62 and the fixing upper sensor 105*a*. The controller 200 is further connected to the stepping motor 51 via the energizing current switching circuit 400. The controller 200 functions as a copying controller 201, a motor controller 202, an energizing current setter 203, and a sheet type information storage 204 by executing a control program stored in e.g. an ROM.

In the above arrangement, the sheet transport direction switching section 109, the energizing current switching circuit 400, the operating section 17, the fixing upper sensor 105*a*, the motor controller 202, the energizing current setter 203, and the sheet type information storage 204 constitute an example of the sheet transport direction switching device 20. The motor controller 202 may be constituted of e.g. an ASIC (Application Specific Integrated Circuit).

The fixing upper sensor 105*a* has a lever shape. In response to transport of a sheet P from the fixing section 13 by the fixing section exit roller pair 106*a*, the fixing upper sensor 105*a* is pushed upward by the sheet P, and is turned on. Thus, the sheet P is detected by the fixing upper sensor 105*a*. When a trail end of a sheet P being transported to the rotary guide member 30 is over the fixing upper sensor 105*a*, the fixing upper sensor 105*a* is returned to the initial position, and is turned off.

The fixing upper sensor 105*a* is in an on-state, while a sheet P passes the fixing upper sensor 105*a*, in other words, while a sheet P transported from the fixing section 13 passes the receiving opening 321 of the guide passage 320. In this arrangement, a timing when the fixing upper sensor 105*a* is changed from an off-state to an on-state corresponds to a timing when a lead end of a sheet P enters the receiving opening 321; and a timing when the fixing upper sensor 105*a* is changed from an on-state to an off-state corresponds to a timing when a trail end of a sheet P enters the receiving opening 321.

The fixing upper sensor 105*a* is not limited to a lever sensor, but may be a sheet sensor incorporated with e.g. a light sensor or an electrostatic sensor.

The copying controller 201 is operable to control operations of the parts in the image forming apparatus 10 to perform a copying operation of a document image. Specifically, the copying controller 201 is operable to control the transport mechanism 120 to transport a sheet P, transmit document image data read by the image reading section 16 to the image forming section 12, and control the image forming section 12 to form an image on the sheet P.

The sheet type information storage 204 is constituted of e.g. an RAM. In response to user's input of sheet type information relating to an elasticity of a sheet P e.g. a type of a sheet P stored in one of the manual tray 18, the sheet cassettes 141, and the large capacity decks 142, such as an ordinary sheet, a thick sheet, or a transparent resin sheet (hereinafter, called as an "OHP sheet") for an OHP (Overhead Projector) through the operating section 17, the sheet type information is stored in the sheet type information storage 204, as elasticity information.

In this embodiment, the elasticity of an OHP sheet corresponds to an example of a first elasticity, and the elasticity of a thick sheet corresponds to an example of a second elasticity.

The energizing current setter 203 is operable to set an energizing current value I1 as a first current value, an energizing current value I2 as a second current value, and an energizing current value I3 as a third current value for energizing a coil of the stepping motor 51, based on the elasticity information stored in the sheet type information storage 204. Specifically, the energizing current setter 203 is operable to set the energizing current values I1, I2, and I3 to respective largest current values, in the case where a sheet P stored in the sheet storing section is judged to be a transparent resin sheet.

The energizing current setter 203 is operable to set the energizing current values I1, I2, and I3 in such a manner that the current value is stepwise decreased in the order of a thick sheet and an ordinary sheet, and that the current value of an ordinary sheet is smallest. The energizing current setter 203 is operable to set the energizing current values I1, I2, and I3 in such a manner that a relation I1>I3>I2 is satisfied. Alternatively, the energizing current value I2 may be set to zero.

In this embodiment, a transparent resin sheet has a largest elasticity i.e. is hard, a thick sheet has a second largest elasticity, and an ordinary sheet has a smallest elasticity i.e. is soft. Accordingly, the energizing current setter 203 is operable to increase the energizing current values I1, I2, and I3, as the elasticity information stored in the sheet type information storage 204 indicates a larger elasticity.

Figure 9:
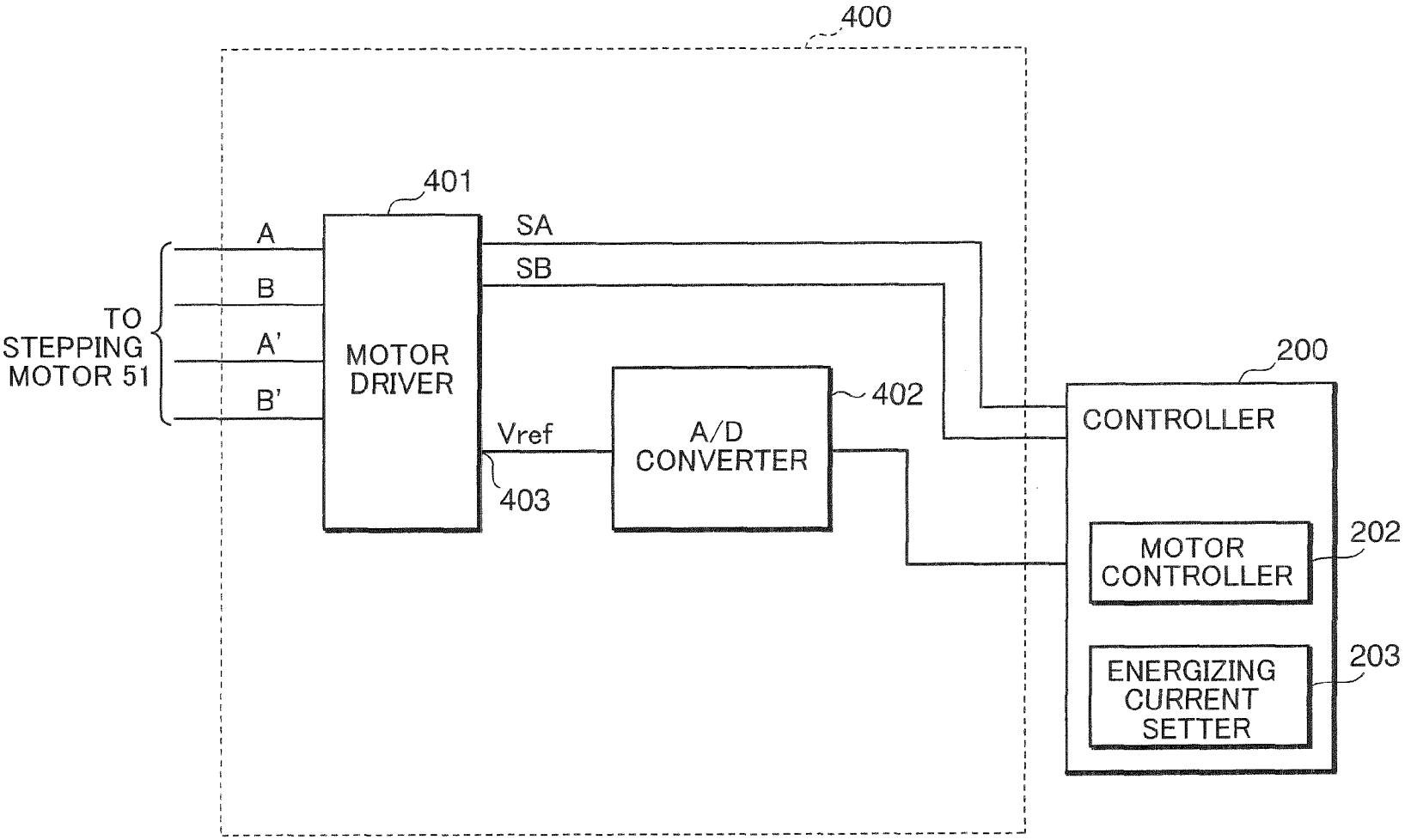
FIG. 9 is a circuit diagram showing an arrangement of an energizing current switching circuit shown in FIG. 8.

FIG. 9 is a circuit diagram showing an example of the energizing current switching circuit 400 shown in FIG. 8. The energizing current switching circuit 400 shown in FIG. 9 includes a motor driver 401 and an analog-to-digital (A/D) converter 402.

The motor driver 401 is a general-purpose driver IC (Integrated Circuit) for driving e.g. a stepping motor. In response to a pulse control signal SA, SB outputted from the controller 200, the motor driver 401 is operable to rotate the stepping motor 51 by a rotation angle corresponding to the number of pulses of the pulse control signal SA, SB by outputting an energizing current of the respective corresponding phases "A", "B", "A'", and "B'" to the stepping motor 51 in a pulse manner.

Specifically, the motor driver 401 is operable to output, to the stepping motor 51, an energizing current of the phase "A", and an energizing current of the phase "A'" opposite to the phase "A" in response to the pulse control signal SA. The motor driver 401 is operable to output, to the stepping motor 51, an energizing current of the phase "B", and an energizing current of the phase "B'" opposite to the phase "B" in response to the pulse control signal SB. The motor driver 401 is also operable to set the values of the energizing currents of the phases "A", "B", "A'", and "B'" in accordance with a reference voltage Vref inputted to a Vref terminal 403 e.g. in proportion to the reference voltage Vref.

The analog-to-digital converter 402 is operable to output a voltage depending on a control signal outputted from the motor controller 202 to the Vref terminal 403 of the motor driver 401, as the reference voltage Vref.

Referring back to FIG. 8, the motor controller 202 is operable to perform an in-timing retaining operation of increasing a retention force of the stepping motor 51 by increasing an energizing current at a timing when a lead end of a sheet P enters the receiving opening 321 of the rotary guide member 30; a pass-timing retaining operation of decreasing an energizing current while a lead end of a sheet P passes the guide passage 320; and an out-timing retaining operation of increasing a retention force of the stepping motor 51 by increasing an energizing current at a timing when a trail end of a sheet P exits the discharge port 351 of the rotary guide member 30, depending on an elasticity of the sheet P.

Specifically, in performing the in-timing retaining operation, the motor controller 202 is operable to judge that a point of time when the fixing upper sensor 105*a* is changed from an off-state to an on-state coincides with a timing when a lead end of a sheet P enters the receiving opening 321; and supply an energizing current of the energizing current value I1 to the stepping motor 51 by outputting a reference voltage Vref corresponding to the energizing current value I1 from the analog-to-digital converter 402 for a predetermined in-retaining time t1, while suspending the stepping motor 51. Thereby, the retention force of the stepping motor 51 is increased.

The in-retaining time t1 is set to e.g. 0.1 second, as a duration from e.g. the point of time when the fixing upper sensor 105*a* is turned on to the point of time when a lead end of a sheet P is abutted against the arc guide plates 32 in the receiving opening 321, and guided to the guide passage 320.

In performing the pass-timing retaining operation, the motor controller 202 is operable to judge that a lead end of a sheet P is in the course of passing the guide passage 320 after lapse of the in-retaining time t1 in the in-timing retaining operation until the fixing upper sensor 105*a* is turned off; and supply an energizing current of the energizing current value I2 to the stepping motor 51 by outputting a reference voltage Vref corresponding to the energizing current value I2 from the analog-to-digital converter 402. Thereby, the energizing current flowing through the coil of the stepping motor 51 is reduced, and heating of the stepping motor 51 is suppressed.

In performing the out-timing retaining operation, the motor controller 202 is operable to judge that a timing when the fixing upper sensor 105*a* is changed from an on-state to an off-state coincides with a timing when a trail end of a sheet P is about to exit through the discharge port 351; and supply an energizing current of the energizing current value I3 to the stepping motor 51 by outputting a reference voltage Vref corresponding to the energizing current value I3 from the analog-to-digital converter 402 during a predetermined out-retaining time t2, while suspending the stepping motor 51.

Thereby, the retention force of the stepping motor 51 is increased. In this case, the out-retaining time t2 is set slightly longer than a time required for a trail end of a sheet P to exit the discharge port 351 from the fixing upper sensor 105*a*, and is set to e.g. 0.3 second including a margin time.

Figure 10:
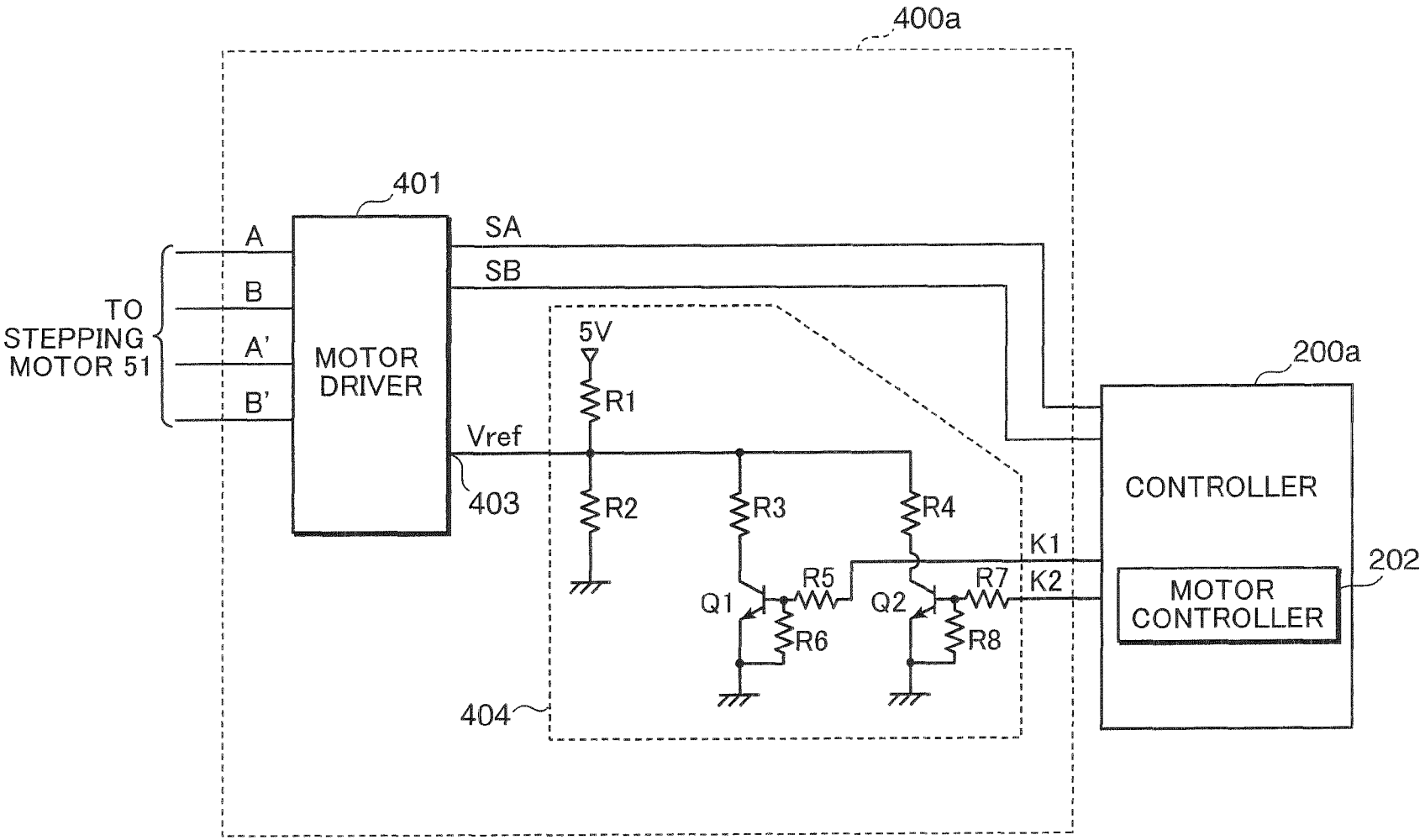
FIG. 10 is a circuit diagram showing a modification of the energizing current switching circuit shown in FIG. 9.

Alternatively, as shown in FIG. 10, an energizing current switching circuit 400*a* may have a reference voltage generating circuit 404, in place of the analog-to-digital converter 402. In use of the energizing current switching circuit 400*a*, a controller 200*a* does not have an energizing current setter 203, and the energizing current values I1, I3, and I2 are fixed.

The reference voltage generating circuit 404 shown in FIG. 10 includes resistors R1 through R8, and transistors Q1 and Q2. A 5V DC voltage is divided by a series current defined by the resistors R1 and R2, and a divided voltage of the DC voltage is inputted to a Vref terminal 403 as a reference voltage Vref. The Vref terminal 403 is grounded via the resistor R3 and the transistor Q1. The resistor R6 is connected between a base and an emitter of the transistor Q1. The base of the transistor Q1 is connected to the controller 200*a* via the resistor R5. In this configuration, when the motor controller 202 sets a pulse control signal K1 to a high level, the transistor Q1 is turned on.

The Vref terminal 403 is grounded via the resistor R4 and the transistor Q2. The resistor R8 is connected between a base and an emitter of the transistor Q2. The base of the transistor Q2 is connected to the controller 200*a* via the resistor R7. In this configuration, when the motor controller 202 sets a pulse control signal K2 to a high level, the transistor Q2 is turned on.

For instance, the resistor R1 has a resistance of 1 kΩ, and the resistors R2, R3, and R4 each has a resistance of 4 kΩ. In this condition, in the case where the motor controller 202 sets the pulse control signal K1, K2 to a low level, the transistors Q1 and Q2 are turned off, and 5V is divided by 1 kΩ and 4 kΩ. Thereby, the reference voltage Vref is set to 4V. Similarly, in the case where the motor controller 202 sets the pulse control signal K1 to a high level, and sets the pulse control signal K2 to a low level, the transistor Q1 is turned on, the transistor Q2 is turned off, and 5V is divided by 1 kΩ and 2 kΩ. Thereby, the reference voltage Vref is set to 3.3V. In the case where the motor controller 202 sets the pulse control signal K1, K2 to a high level, the transistors Q1 and Q2 are turned on, and 5V is divided by 1 kΩ and ⅔ kΩ. Thereby, the reference voltage Vref is set to 2.9V.

In this embodiment, resistance values of the resistors R1 through R4 are set in such a manner that: the energizing current of the stepping motor 51, to be outputted from the motor driver 401 when the transistors Q1 and Q2 are turned off, is set to the energizing current value I1; the energizing current of the stepping motor 51, to be outputted from the motor driver 401 when one of the transistors Q1 and Q2 is turned off, is set to the energizing current value I3; and the energizing current of the stepping motor 51, to be outputted from the motor driver 401 when the transistors Q1 and Q2 are turned on, is set to the energizing current value I2.

In the above arrangement, the reference voltage generating circuit 404 incorporated with resistors and transistors is operable to generate a reference voltage Vref without the analog-to-digital converter 402. This is advantageous in reducing the production cost of the image forming apparatus 10.

Figure 11:
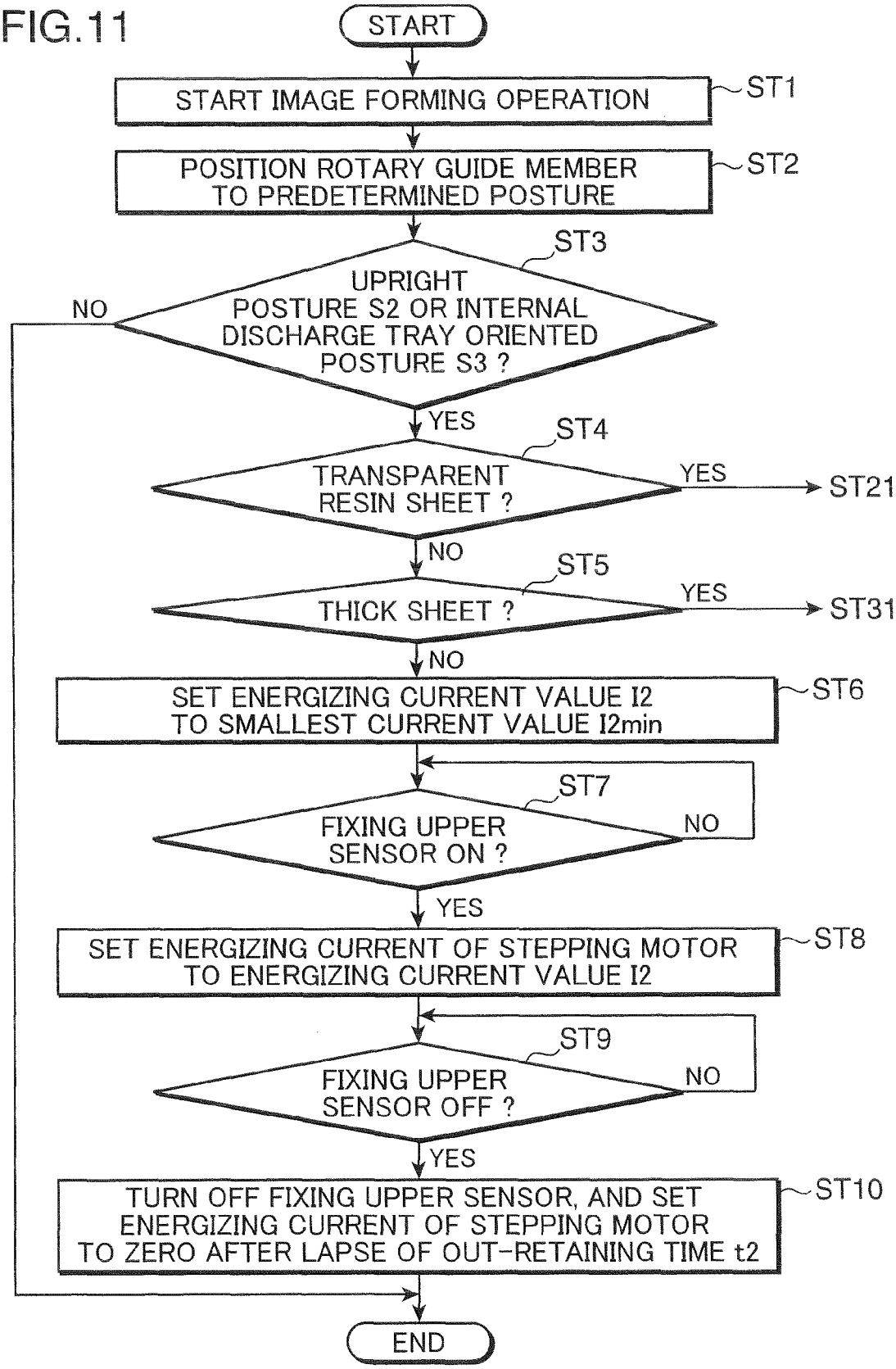
FIG. 11 is a flowchart showing an operation to be performed by the image forming apparatus shown in FIG. 1.
Figure 12:
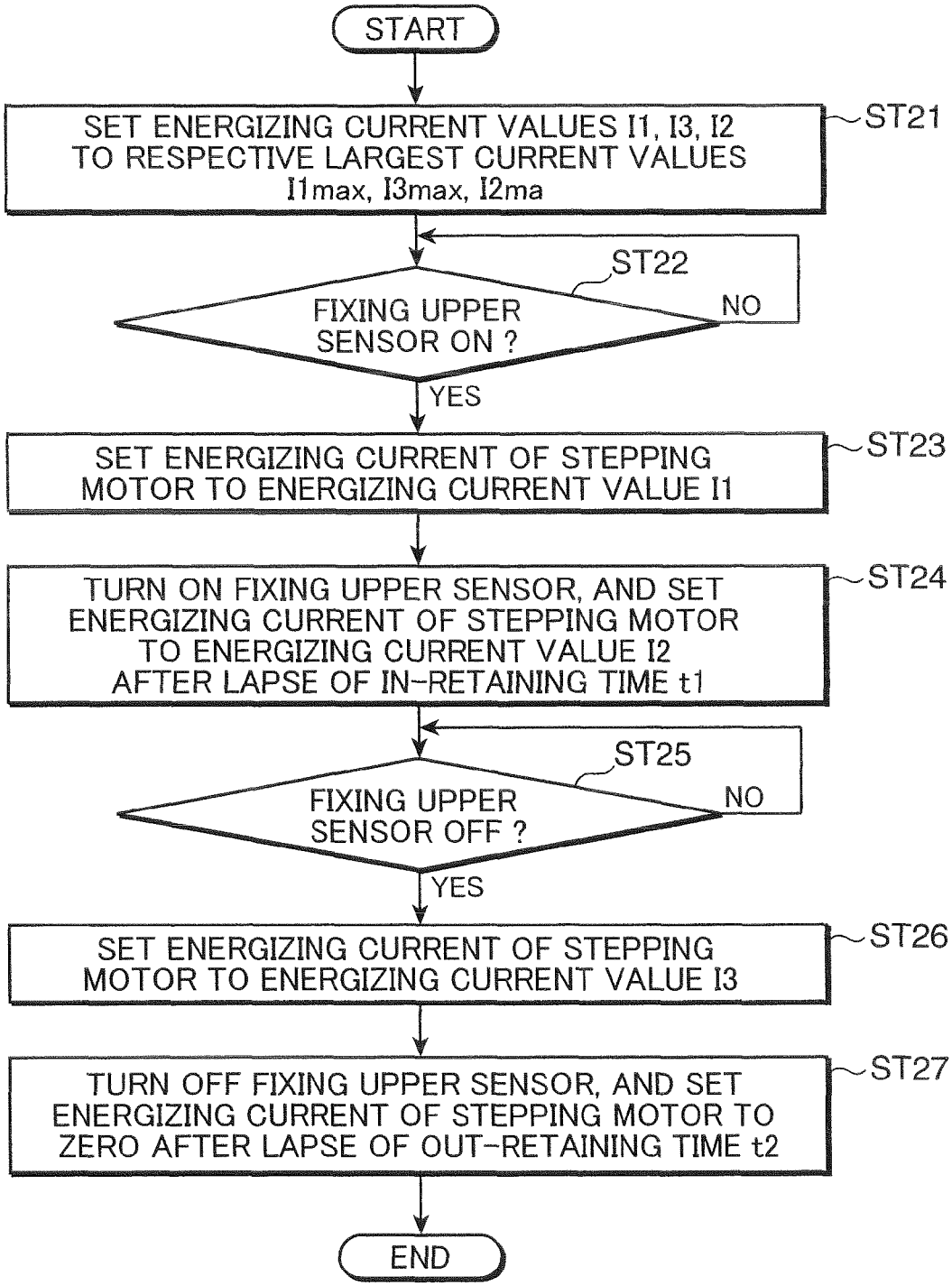
FIG. 12 is a flowchart showing an operation to be performed by the image forming apparatus shown in FIG. 1.
Figure 13:
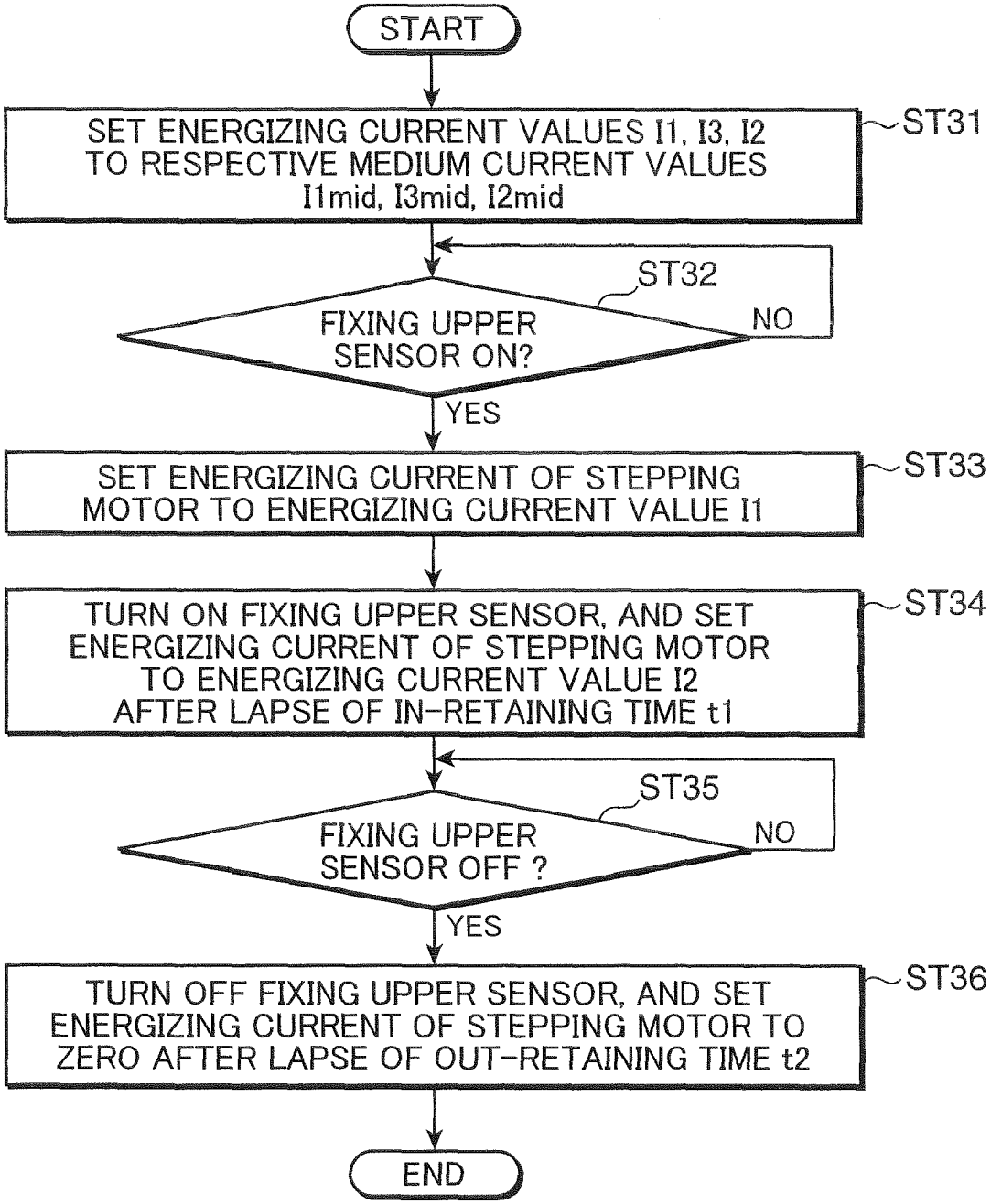
FIG. 13 is a flowchart showing an operation to be performed by the image forming apparatus shown in FIG. 1.

In the following, an operation to be performed by the image forming apparatus 10 having the above arrangement is described. FIGS. 11, 12, and 13 are flowcharts showing an example of an operation to be performed by the image forming apparatus 10 shown in FIG. 1. First, in response to user's pressing the operation key section 171 to copy a document, the copying controller 201 controls the operations of the image reading section 16, the image forming section 12, the fixing section 13, and the transport mechanism 120 to start an image forming operation (Step ST1).

Then, the motor controller 202 outputs, to the motor driver 401, a pulse control signal SA, SB indicating a required number of pulses to set the rotary guide member 30 at a predetermined posture depending on the setting contents of a job such as a discharge destination of a sheet P, a one-side printing operation, or a double-side printing operation. Upon receiving the pulse control signal SA, SB, the motor driver 401 outputs an energizing current of a predetermined phase to the stepping motor 51 depending on the pulse control signal SA, SB to drive the stepping motor 51. As a result of the driving operation of the stepping motor 51, the rotary guide member 30 is set at the predetermined posture depending on the setting contents of a job (Step ST2).

Then, the motor controller 202 checks whether the posture of the rotary guide member 30 coincides with one of the upright posture S2 and the internal discharge tray oriented posture S3, in other words, whether the discharge port 351 is aligned with one of the upper end transport path 101 and the flip-flop path 103 (Step ST3).

If it is judged that the posture of the rotary guide member 30 does not coincide with one of the upright posture S2 and the internal discharge tray oriented posture S3 (NO in Step S3), the routine is ended. If, on the other hand, it is judged that the posture of the rotary guide member 30 coincides with one of the upright posture S2 and the internal discharge tray oriented posture S3 (YES in Step S3), the motor controller 202 checks the sheet type information stored in the sheet type information storage 204 (Steps ST4 and ST5).

If it is judged that a sheet P stored in the sheet storing section for image formation is an OHP sheet (YES in Step ST4), the routine proceeds to Step ST21 to drive the stepping motor 51 with a retention force corresponding to a sheet having a largest elasticity. If it is judged that a sheet P stored in the sheet storing section for image formation is a thick sheet (NO in Step ST4 and YES in Step ST5), the routine proceeds to Step ST31 to drive the stepping motor 51 with a retention force corresponding to a sheet having a medium elasticity.

If it is judged that a sheet P stored in the sheet storing section for image formation is an ordinary sheet (NO in Step ST4 and NO in Step ST5), the routine proceeds to Step ST6 to drive the stepping motor 51 with a retention force corresponding to a sheet having a smallest elasticity.

Specifically, if it is judged that a sheet P stored in the sheet storing section for image formation is an OHP sheet (YES in Step ST4), in Step ST21, the energizing current setter 203 sets the energizing current values I1, I3, and I2 to current values I1max, I3max, and I2max, respectively.

The current value I1max is an energizing current value capable of generating a retention force of the stepping motor 51 that enables to prevent the rotary guide member 30 from rotating by a rotation torque exerted from an OHP sheet having a large elasticity, when the OHP sheet is transported from the fixing section 13 by the fixing section exit roller pair 106*a*, and a lead end of the OHP sheet is abutted against the arc guide plates 32 in the receiving opening 321.

The current value I3max is defined as follows. Specifically, a sheet P is bent by the rotary guide member 30 to change a transport direction thereof. Accordingly, when a trail end of a sheet P exits the discharge port 351, the trail end of the sheet P springs back by a resilient restoring force of the sheet P. The current value I3max is an energizing current value capable of generating a retention force of the stepping motor 51 that enables to prevent the rotary guide member 30 from rotating by a rotation torque exerted from an OHP sheet having a large elasticity, when a trail end of the OHP sheet presses against the discharge port 351 with a resilient restoring force while exiting the discharge port 351.

In the above condition, a rotation torque to be exerted to the rotary guide member 30 when a lead end of an OHP sheet is abutted against the arc guide plates 32 in the receiving opening 321 is larger than a rotation torque to be exerted to the rotary guide member 30 when the OHP sheet is returned to its initial state by a resilient restoring force. Accordingly, the current value I1max is set larger than the current value I3max.

The current value I2max is an energizing current value capable of generating a retention force of the stepping motor 51 that enables to prevent the rotary guide member 30 from rotating by a rotation torque exerted to the rotary guide member 30, when the guide pulleys 40 are rotated by frictional contact with an OHP sheet having a large elasticity while the OHP sheet passes the guide passage 320, or when the OHP sheet is contacted with the arc guide plates 32.

In the above condition, a rotation torque to be exerted to the rotary guide member 30 while an OHP sheet passes the guide passage 320 is smaller than a rotation torque to be exerted to the rotary guide member 30 while the OHP sheet enters the receiving opening 321 or exits the discharge port 351. Accordingly, the current value I2max is set smaller than the current values I1max and I3max.

Subsequently, the motor controller 202 checks whether the fixing upper sensor 105*a* is turned on (Step ST22). If it is judged that the fixing upper sensor 105*a* is turned on (YES in Step ST22), the judgment result means that a lead end of a sheet P has reached the fixing upper sensor 105*a*, in other words, a timing when a lead of a sheet P is immediately before abutting against the arc guide plates 32 in the receiving opening 321. In this condition, the motor controller 202 is operable to output, to the energizing current switching circuit 400, a pulse control signal SA, SB to supply an energizing current of a phase capable of retaining the stepping motor 51 at a current position; and a command signal to set the value of the energizing current to be supplied to the stepping motor 51 to the energizing current value I1.

Then, the energizing current switching circuit 400 is operable to output an energizing current of the respective corresponding phases "A", "B", "A'", and "B'" to the stepping motor 51 so as to retain the stepping motor 51 in a suspended state; and set the value of the energizing current to be supplied to the stepping motor 51 to the energizing current value I1 (Step ST23).

In the above arrangement, the retention torque of the stepping motor 51 can be increased by setting the value of the energizing current to be supplied to the stepping motor 51 to the energizing current value I1 at a timing when a lead end of a sheet P is abutted against the arc guide plates 32, and a rotation torque is exerted to the rotary guide member 30. This is advantageous in suppressing rotation of the rotary guide member 30 when a lead end of a sheet P enters the receiving opening 321.

Then, the motor controller 202 is operable to output a command signal to the energizing current switching circuit 400, upon lapse of the in-retaining time t1 after the fixing upper sensor 105*a* is turned on, to set the value of the energizing current to be supplied to the stepping motor 51 to the energizing current value I2 (Step ST24). Thereby, the value of the energizing current to be supplied to the stepping motor 51 is lowered to the energizing current value I2 by the energizing current switching circuit 400.

Upon lapse of the in-retaining time t1 after the fixing upper sensor 105*a* is turned on, the sheet P is allowed to pass the guide passage 320 while being guided by the arc guide plates 32. In this case, a rotation torque to be exerted to the rotary guide member 30 is reduced. Accordingly, setting the value of the energizing current to be supplied to the stepping motor 51 to the energizing current value I2 enables to suppress a heating operation of the stepping motor 51, while retaining the posture of the rotary guide member 30.

Then, the motor controller 202 checks whether the fixing upper sensor 105*a* is turned off (Step ST25). If it is judged that the fixing upper sensor 105*a* is turned off (YES in Step ST25), the judgment result means that a trail end of a sheet P is located at the fixing upper sensor 105*a* i.e. immediately in front of the receiving opening 321, and is about to exit the discharge port 351 upon lapse of a short time required for the sheet P to pass the guide passage 320.

Then, the motor controller 202 is operable to output, to the energizing current switching circuit 400, the pulse control signal SA, SB to supply an energizing current of a phase capable of retaining the stepping motor 51 at a current position; and a command signal to set the value of the energizing current to be supplied to the stepping motor 51 to the energizing current I3. Thereby, the value of the energizing current to be supplied to the stepping motor 51 is set to the energizing current value I3 by the energizing current switching circuit 400 (Step ST26).

In the above arrangement, the retention torque of the stepping motor 51 can be increased by setting the value of the energizing current to be supplied to the stepping motor 51 to the energizing current value I3 at a timing when a trail end of an OHP sheet having a large elasticity presses against the discharge port 351 by a resilient restoring force while the OHP sheet exits the discharge port 351. This is advantageous in suppressing rotation of the rotary guide member 30 when a trail end of a sheet exits the discharge port 351.

Then, the motor controller 202 is operable to set the pulse control signal SA, SB to a low level upon lapse of the out-retaining time t2 after the fixing upper sensor 105*a* is turned off, in other words, at a timing when a sheet P exits the discharge port 351 and there is no likelihood that a trail end of the sheet P may be abutted against the rotary guide member 30. Then, the motor driver 401 is operable to set the value of the energizing current to be supplied to the stepping motor 51 to zero, whereby the stepping motor 51 is retained with a detent torque (Step ST27).

In the above arrangement, by the time when the rotary guide member 30 is free of a rotation torque by transport of a sheet P, the value of the energizing current to be supplied to the stepping motor 51 is set to zero, and the stepping motor is retained with a detent torque. This enables to suppress a heating operation of the stepping motor 51, while retaining the posture of the rotary guide member 30.

Next, an operation to be performed by the image forming apparatus 10 in the case where a sheet P stored in the sheet storing section for image formation is a thick sheet is described. In this case, in Step ST31, the energizing current setter 203 sets the energizing current values I1, I3, I2 to current values I1mid, I3mid, I2mid, respectively.

The current value I1mid is an energizing current value capable of generating a retention force of the stepping motor that enables to prevent the rotary guide member 30 from rotating by a rotation torque exerted from a thick sheet having a medium elasticity, when the thick sheet is transported from the fixing section 13 by the fixing section exit roller pair 106*a*, and a lead end of the thick sheet is abutted against the arc guide plates 32 in the receiving opening 321.

The current value I3mid is an energizing current value capable of generating a retention force of the stepping motor that enables to prevent the rotary guide member 30 from rotating by a rotation torque exerted from a thick sheet having a medium elasticity, when a trail end of the thick sheet presses against the discharge port 351 with a resilient restoring force while exiting the discharge port 351.

In the above condition, a rotation torque to be exerted to the rotary guide member 30 when a lead end of a thick sheet is abutted against the arc guide plates 32 in the receiving opening 321 is larger than a rotation torque to be exerted to the rotary guide member 30 when the thick sheet is returned to its initial state by a resilient restoring force. Accordingly, the current value I1mid is set larger than the current value I3mid.

The current value I2mid is an energizing current value capable of generating a retention force of the stepping motor 51 that enables to prevent the rotary guide member 30 from rotating by a rotation torque exerted to the rotary guide member 30, when the guide pulleys 40 are rotated by frictional contact with a thick sheet having a medium elasticity while the thick sheet passes the guide passage 320, or when the thick sheet is contacted with the arc guide plates 32.

In the above condition, a rotation torque to be exerted to the rotary guide member 30 while a thick sheet passes the guide passage 320 is smaller than a rotation torque to be exerted to the rotary guide member 30 while the thick sheet enters the receiving opening 321 or exits the discharge port 351. Accordingly, the current value I2mid is set smaller than the current values I1mid and I3mid.

The elasticity of a thick sheet is smaller than the elasticity of an OHP sheet. Accordingly, the current values I1mid, I3mid, I2mid are set to satisfy the requirements: the current value I1mid is smaller than the current value I1max; the current value I3mid is smaller than the current value I3max; and the current value I2mid is smaller than the current value I2max.

Since Steps ST32 through ST34 are substantially equivalent to Steps ST22 through ST24, description thereof is omitted herein. In this embodiment, since the current values I1mid, I3mid, I2mid are set smaller than the current values I1max, I3max, I2max, respectively, the energizing current values I1, I3, I2 in Steps ST32 through ST34 become smaller than the energizing current values I1, I3, I2 in Steps ST22 through ST24. This enables to reduce an energizing current, while suppressing rotation of the rotary guide member 30, depending on the elasticity of a sheet P.

Next, Steps ST35 and ST36 substantially equivalent to Steps ST25 and ST27 are executed.

In the above condition, a rotation torque to be exerted to the rotary guide member 30 at a timing when a sheet P exits the discharge port 351 is smaller than a rotation torque to be exerted to the rotary guide member 30 at a timing when the sheet P enters the receiving opening 321. A rotation torque to be exerted to the rotary guide member 30 in the case where a sheet P is a thick sheet is smaller than in the case where a sheet P is an OHP sheet. Accordingly, in the case where a sheet P is a thick sheet, the rotary guide member 30 is less likely to be rotated, even if the energizing current is kept at the energizing current value I2, by suspending an out-timing retaining operation of increasing an energizing current at a timing when a sheet P exits the discharge port 351.

In view of the above, executing Steps ST35 and ST36 without executing an out-timing retaining operation corresponding to Step ST26 enables to reduce an energizing current, while suppressing rotation of the rotary guide member 30.

Alternatively, an operation substantially equivalent to Step ST26 may be executed following Step ST35. The energizing current value I3 in performing an operation substantially equivalent to Step ST26 becomes smaller than the energizing current value I3 in performing Step ST26. Accordingly, the modification enables to reduce an energizing current, while suppressing rotation of the rotary guide member 30.

Next, an operation to be performed by the image forming apparatus 10 in the case where a sheet P stored in the sheet storing section for image formation is an ordinary sheet is described. In this case, in Step ST6, the energizing current setter 203 sets the energizing current values I1, I3, I2 to current values I1min, I3min, I2min, respectively.

The current value I1min is an energizing current value capable of generating a retention force of the stepping motor 51 that enables to prevent the rotary guide member 30 from rotating by a rotation torque exerted from an ordinary sheet having a small elasticity, when the ordinary sheet is transported from the fixing section 13 by the fixing section exit roller pair 106*a*, and a lead end of the ordinary sheet is abutted against the arc guide plates 32 in the receiving opening 321.

The current value I3min is an energizing current value capable of generating a retention force of the stepping motor 51 that enables to prevent the rotary guide member 30 from rotating by a rotation torque exerted from an ordinary sheet having a small elasticity, when a trail end of the ordinary sheet presses against the discharge port 351 by a resilient restoring force while exiting the discharge port 351.

In the above condition, a rotation torque to be exerted to the rotary guide member 30 when a lead end of an ordinary sheet is abutted against the arc guide plates 32 in the receiving opening 321 is larger than a rotation torque to be exerted to the rotary guide member 30 when the ordinary sheet is returned to its initial state by a resilient restoring force. Accordingly, the current value I1min is set larger than the current value I3min.

The current value I2min is an energizing current value capable of generating a retention force of the stepping motor 51 that enables to prevent the rotary guide member 30 from rotating by a rotation torque exerted to the rotary guide member 30, when the guide pulleys 40 are rotated by frictional contact with an ordinary sheet having a small elasticity while the ordinary sheet passes the guide passage 320, or when the ordinary sheet is contacted with the arc guide plates 32.

In the above condition, a rotation torque to be exerted to the rotary guide member 30 while an ordinary sheet passes the guide passage 320 is smaller than a rotation torque to be exerted to the rotary guide member 30 while the ordinary sheet enters the receiving opening 321 or exits the discharge port 351. Accordingly, the current value I2min is set smaller than the current values I1min and I3min.

The elasticity of an ordinary sheet is smaller than the elasticity of an OHP sheet or a thick sheet. Accordingly, the current values I1min, I3min, I2min are set to satisfy the requirements: the current value I1min is smaller than the current values I1max and I1mid; the current value I3min is smaller than the current values I3max and I3mid; and the current value I2min is smaller than the current values I2max and I2mid.

Next, Step ST7 substantially equivalent to Step ST22 is executed. A rotation torque to be exerted to the rotary guide member 30 in the case where a sheet P is an ordinary sheet is smaller than in the case where a sheet P is an OHP sheet or a thick sheet. Accordingly, in the case where a sheet P is an ordinary sheet, the rotary guide member 30 is less likely to be rotated, even if the energizing current is kept at the energizing current value I2, without executing an in-timing retaining operation of increasing an energizing current at a timing when a lead end of the sheet P enters the receiving opening 321, and an out-timing retaining operation of increasing an energizing current at a timing when the sheet P exits the discharge port 351.

In the above arrangement, the motor controller 202 may output, to the energizing current switching circuit 400, a pulse control signal SA, SB to supply an energizing current of a phase capable of retaining the stepping motor 51 at a current position; and a command signal to set the energizing current to be supplied to the stepping motor 51 to the energizing current value I2, thereby causing the energizing current switching circuit 400 to output an energizing current of the respective corresponding phases "A", "B", "A'", and "B'" to retain the stepping motor 51 in a suspended state, and set the value of the energizing current to be supplied to the stepping motor 51 to the energizing current value I2 (Step ST8).

Thereafter, Steps ST9 and ST10 corresponding to Steps ST25 and ST26 are executed without executing operations corresponding to Steps ST24 and ST26. Thus, an energizing current can be reduced while suppressing rotation of the rotary guide member 30.

Alternatively, operations substantially equivalent to Steps ST23 and ST24 may be executed following Step ST7, and an operation substantially equivalent to Step ST26 may be executed following Step ST9. The energizing current values I1 and I3 in performing the operations substantially equivalent to Steps ST23, ST24, and ST26 become smaller than the energizing current values I1 and I3 in performing Steps ST23 and ST26. Accordingly, the modification is advantageous in reducing an energizing current, while suppressing rotation of the rotary guide member 30.

As described above, the sheet transport direction switching device 20 is operable to suppress rotation of the rotary guide member 30 by a rotation torque exerted to the rotary guide member 30 when a sheet P is abutted against the guide passage 320, while suppressing a heating operation of the stepping motor 51, by controlling an energizing current to be supplied to the stepping motor 51. This is advantageous in reducing the production cost of the image forming apparatus 10, without the need of providing a brake mechanism for the rotary guide member 30.

In the case where a retention force of the stepping motor 51 is generated by continuing supply of an energizing current to the stepping motor 51, the coil of the stepping motor 51 may be heated, and the stepping motor 51 may be damaged. The sheet transport direction switching device 20 shown in FIG. 8 enables to increase the retention force of the stepping motor by increasing an energizing current solely at a timing when an increase in rotation torque resulting from transport of a sheet P is supposed to increase. This is advantageous in suppressing a heating operation of the coil, and suppressing damage of the stepping motor 51.

In the case where the posture of the rotary guide member is retained solely by a detent torque of the stepping motor in transporting a sheet P, a rotated position of the rotary guide member 30 may be displaced, each time a sheet P is guided by the rotary guide member 30. Accordingly, positioning the rotary guide member 30 is necessary, each time a sheet P is guided.

In the above condition, it is impossible to control a rotation angle of the stepping motor 51 at an absolute value, and it is necessary to control the stepping motor 51 based on a rotation angle relative to a reference position thereof. Accordingly, it is necessary to position the stepping motor 51, followed by returning the rotary guide member 30 to the reference posture S1, each time a sheet P is guided, and detecting the reference position of the stepping motor 51 by the reference position detector 60; or position the stepping motor 51 by providing position detection sensors substantially equivalent to the reference position detector 60 at positions corresponding to the respective postures of the rotary guide member 30.

In the case where the rotary guide member 30 is returned to the reference posture S1, each time a sheet P is guided, it takes a time for positioning the rotary guide member 30, and a printing time required for forming an image on multiple sheets may be increased. In the case where multiple position detection sensors are provided at the positions corresponding to the respective postures of the rotary guide member 30, the cost relating to the sensors may be increased.

The sheet transport direction switching device 20 is operable to suppress rotation of the rotary guide member 30 by a rotation torque exerted to the rotary guide member 30 when a sheet P is abutted against the guide passage 320. This eliminates the need of positioning the rotary guide member 30, each time a sheet P is guided, thereby suppressing an increase in printing time. Since the sheet transport direction switching device 20 eliminates the need of providing multiple position detection sensors for detecting the positions of the stepping motor 51, there is no likelihood that the cost relating to the position detection sensors may be increased.

In this embodiment, sheet type information relating to a sheet P corresponds to an example of elasticity information. Elasticity information is not limited to the sheet type information, but may be numerical data expressing e.g. a thickness of a sheet P or a magnitude of elasticity of a sheet P. In this embodiment, the sheet type information as elasticity information is acquired by user's input by way of the operating section 17. Alternatively, the elasticity information acquirer may be operable to acquire elasticity information by e.g. automatically measuring a thickness of a sheet P or measuring a magnitude of elasticity of a sheet P.

In this embodiment, the elasticity information are related to three types of sheets i.e. an OHP sheet, a thick sheet, and an ordinary sheet. Alternatively, the elasticity information may be related to two types or four or more types of sheets in terms of elasticity. Further alternatively, the elasticity information may not be used, and the energizing current setter 203 and the sheet type information storage 204 may be omitted. Further alternatively, the motor controller 202 may be operable to execute one of Steps ST22 through ST27, and ST32 through ST36, without depending on the elasticity information.

In this embodiment, the fixing upper sensor 105*a* serves as a lead end in-timing acquirer and a trail end out-timing acquirer. Alternatively, a sensor other than the fixing upper sensor 105*a* may be provided in the vicinity of a front region of the discharge opening 322 in the guide passage 320, as a trail end out-timing acquirer.

Further alternatively, the lead end in-timing acquirer and the trail end out-timing acquirer may not be necessarily a sensor. For instance, it may be possible to calculate a timing when a lead end of a sheet P enters the receiving opening 321, or a timing when a trail end of a sheet P exits the discharge port 351, based on a lapse of time after an image is formed on the sheet P.

In this embodiment, the sheet transport direction switching device 20 is applied to the image forming apparatus 10. Alternatively, the sheet transport direction switching device 20 may be applied to a device for processing a sheet e.g. a post-processing device, disposed downstream of the image forming apparatus 10 in communication with the image forming apparatus 10, for performing a post-processing operation such as stapling on a discharged sheet P.

In this embodiment, a copying machine is used as an example of the image forming apparatus 10. Alternatively, the image forming apparatus is not limited to a copying machine, but may be a printer or a facsimile machine.

A sheet transport direction switching device according to an aspect of the invention includes: a rotary guide member having a guide passage for passing a sheet to be transported, and pivotally movable about an axis of a support shaft extending in a direction orthogonal to a sheet transport direction to such a posture as to align an exit of the guide passage with at least one of two discharge destinations; a stepping motor for changing the posture of the rotary guide member; a motor controller for controlling a rotation of the stepping motor by supplying an energizing current through a coil to the stepping motor; and a lead end in-timing acquirer for acquiring a timing when a lead end of the sheet enters an entrance of the guide passage. The motor controller is operable to perform, in a state that the exit of the guide passage is aligned with at least one of the two discharge destinations, an in-timing retaining operation of retaining a rotated position of the stepping motor by supplying an energizing current of a first current value to the stepping motor at the timing, acquired by the lead end in-timing acquirer, when the lead end of the sheet enters the entrance of the guide passage, and a pass timing retaining operation of reducing the energizing current to a second current value smaller than the first current value when the lead end of the sheet passes the guide passage.

In the above arrangement, the lead end in-timing acquirer is operable to acquire a timing when a lead end of a sheet enters the entrance of the guide passage, and a rotation torque may be exerted to the rotary guide member by abutment of the sheet against the guide passage. Then, the motor controller is operable to perform an in-timing retaining operation of retaining a rotated position of the stepping motor by supplying an energizing current of the first current value to the stepping motor at the timing when the lead end of the sheet enters the entrance of the guide passage. Thereby, the retention force of the stepping motor becomes larger than the detent torque of the stepping motor. This is advantageous in suppressing rotation of the rotary guide member by a rotation torque resulting from abutment of a sheet against the guide passage. In this condition, if supply of an energizing current to the stepping motor in a suspended state of the stepping motor is continued, the stepping motor may be heated. Also, a rotation torque to be exerted to the rotary guide member is reduced, when a lead end of a sheet passes the guide passage. In view of this, the motor controller is operable to perform a pass timing retaining operation of reducing an energizing current to the second current value smaller than the first current value when the lead end of the sheet passes the guide passage. This is advantageous in reducing an energizing current to be supplied to the stepping motor, and suppressing heating of the stepping motor.

An image forming apparatus according to another aspect of the invention includes the aforementioned sheet transport direction switching device, and an image forming section for forming an image on the sheet based on predetermined image data.

The above arrangement enables to suppress rotation of the rotary guide member provided in the sheet transport direction switching device for use in image formation of the image forming apparatus by a rotation torque exerted to the rotary guide member by abutment against a sheet.

Preferably, the sheet transport direction switching device may further include a trail end out-timing acquirer for acquiring a timing when a trail end of the sheet exits the exit of the guide passage, wherein the motor controller is further operable to perform an out-timing retaining operation of retaining the rotated position of the stepping motor by supplying an energizing current of a third current value larger than the second current value to the stepping motor at the timing, acquired by the trail end out-timing acquirer, when the trail end of the sheet exits the exit of the guide passage in a state that the exit of the guide passage is aligned with at least one of the two discharge destinations.

In the above arrangement, the trail end out-timing acquirer is operable to acquire a timing when a trail end of a sheet exits the exit of the guide passage, and a rotation torque may be exerted to the rotary guide member by a resilient restoring force of the sheet which has been bent while passing the guide passage. Then, the motor controller is operable to perform an out-timing retaining operation of retaining the rotated position of the stepping motor by supplying an energizing current of the third current value larger than the second current value to the stepping motor at the timing when the trail end of the sheet exits the exit of the guide passage. Thereby, the retention force of the stepping motor becomes larger than the detent torque of the stepping motor. This is advantageous in suppressing rotation of the rotary guide member by a resilient restoring force of the sheet.

Preferably, the third current value may be smaller than the first current value.

A resilient restoring force of a sheet is smaller than a force to be exerted to the rotary guide member when a lead end of the sheet is abutted against the guide passage. Accordingly, lowering an energizing current of the third current value to be supplied to the stepping motor at a timing when a trail end of a sheet exits the exit of the guide passage than an energizing current of the first current value to be supplied to the stepping motor at a timing when a lead end of the sheet enters the entrance of the guide passage enables to suppress heating of the stepping motor.

Preferably, the sheet transport direction switching device may further include an elasticity information acquirer for acquiring information relating to an elasticity of the sheet, as elasticity information, wherein the motor controller is operable to perform the in-timing retaining operation, in the case where the elasticity information acquired by the elasticity information acquirer indicates an elasticity equal to or larger than a predetermined first elasticity.

A rotation torque to be exerted to the rotary guide member by abutment of a sheet against the guide passage is increased, as the elasticity of the sheet is increased. In the above arrangement, in the case where the elasticity information acquired by the elasticity information acquirer indicates an elasticity equal to or larger than the predetermined first elasticity, and the rotary guide member is highly likely to be rotated by abutment against a sheet, the motor controller is operable to perform the in-timing retaining operation. If, on the other hand, in the case where the elasticity of a sheet is smaller than the first elasticity, the rotary guide member is less likely to be rotated by abutment against a sheet. In this case, heating of the stepping motor can be suppressed without increasing the amount of energizing current by the in-timing retaining operation.

Preferably, the sheet transport direction switching device may further include an elasticity information acquirer for acquiring information relating to an elasticity of the sheet, as elasticity information, wherein the motor controller is operable to perform the in-timing retaining operation and the out-timing retaining operation, in the case where the elasticity information acquired by the elasticity information acquirer indicates an elasticity equal to or larger than a predetermined first elasticity, and the motor controller is operable to perform the in-timing retaining operation, and inoperable to perform the out-timing retaining operation, in the case where the elasticity information acquired by the elasticity information acquirer indicates an elasticity smaller than the first elasticity, and equal to or larger than a second elasticity smaller than the first elasticity.

In the above arrangement, in the case where the elasticity information acquired by the elasticity information acquirer indicates an elasticity equal to or larger than the predetermined first elasticity, and the rotary guide member is highly likely to be rotated by abutment against a sheet, the motor controller is operable to perform the in-timing retaining operation and the out-timing retaining operation. On the other hand, in the case where the elasticity of a sheet is smaller than the first elasticity, a rotation torque to be exerted to the rotary guide member by abutment against the sheet is reduced. Accordingly, a rotation torque to be exerted to the rotary guide member is synergetically reduced at a timing when a trail end of a sheet exits the exit of the guide passage, in other words, a timing when a rotation torque to be exerted to the rotary guide member is reduced, as compared with a timing when a lead end of the sheet enters the entrance of the guide passage. In view of this, in the case where the elasticity information acquired by the elasticity information acquirer indicates an elasticity smaller than the first elasticity and equal to or larger than the second elasticity smaller than the first elasticity, heating of the stepping motor can be advantageously suppressed, as compared with an arrangement that the out-timing retaining operation is performed without depending on the elasticity of a sheet, by suspending the out-timing retaining operation i.e. without increasing the amount of energizing current.

Preferably, the motor controller may be inoperable to perform the in-timing retaining operation and the out-timing retaining operation, in the case where the elasticity information acquired by the elasticity information acquirer indicates an elasticity smaller than the second elasticity.

In the case where the elasticity of a sheet is smaller than the second elasticity, and the rotary guide member is less likely to be rotated by abutment against the sheet even at a timing when a lead end of the sheet enters the entrance of the guide passage, the motor controller is inoperable to perform the in-timing retaining operation and the out-timing retaining operation. In this arrangement, there is no likelihood that the amount of energizing current may increase by the in-timing retaining operation and the out-timing retaining operation. Thus, the above arrangement enables to suppress heating of the stepping motor, as compared with an arrangement that the in-timing retaining operation is performed in the case where the elasticity of a sheet is smaller than the second elasticity.

Preferably, the sheet transport direction switching device may further include an elasticity information acquirer for acquiring information relating to an elasticity of the sheet, as elasticity information, and an energizing current setter for increasing the first current value, as the elasticity information acquired by the elasticity information acquirer indicates a larger elasticity.

A rotation torque to be exerted to the rotary guide member by abutment of a sheet against the guide passage is increased, as the elasticity of the sheet is increased. In the above arrangement, the energizing current setter is operable to increase the energizing current value in the in-timing retaining operation to increase the retention force of the stepping motor, as the elasticity of the sheet is increased. This is advantageous in suppressing rotation of the rotary guide member by abutment of a sheet against the guide passage.

Preferably, the elasticity information acquirer may be operable to acquire sheet type information as to whether the sheet is an ordinary sheet or a thick sheet, as the elasticity information, and the elasticity of the thick sheet is defined as the first elasticity.

In the above arrangement, in the case where a thick sheet having an elasticity larger than the elasticity of an ordinary sheet is transported, the in-timing retaining operation is performed to increase the retention force of the stepping motor. This is advantageous in suppressing rotation of the stepping motor, even in the case where a larger rotation torque than a torque by abutment of an ordinary sheet against the guide passage is exerted to the rotary guide member by abutment of a thick sheet against the guide passage.

Preferably, the elasticity information acquirer may be operable to acquire sheet type information as to whether the sheet is an ordinary sheet, a thick sheet, or a resin sheet, as the elasticity information, and the elasticity of the resin sheet is defined as the first elasticity, and the elasticity of the thick sheet is defined as the second elasticity.

In the above arrangement, in the case where a resin sheet having an elasticity larger than the elasticity of an ordinary sheet or a thick sheet is transported, the in-timing retaining operation and the out-timing retaining operation are performed to increase the retention force of the stepping motor both at the timing when the resin sheet enters the guide passage and the timing when the resin sheet exits the guide passage. This is advantageous in suppressing rotation of the rotary guide member by abutment against a resin sheet or a spring-back operation of a resin sheet. Further, in the case where a thick sheet having a smaller elasticity than the elasticity of a resin sheet is transported, the out-timing retaining operation is not performed. This enables to reduce the amount of energizing current at a timing when a thick sheet exits the guide passage, and a rotation torque to be exerted to the rotary guide member is reduced than a timing when the thick sheet enters the guide passage, as compared with a condition that a resin sheet is transported. Thus, heating of the coil can be suppressed.

In the sheet transport direction switching device and the image forming apparatus having the above arrangements, the lead end in-timing acquirer is operable to acquire a timing when a lead end of a sheet enters the entrance of the guide passage, and a rotation torque may be exerted to the rotary guide member by abutment of the sheet against the guide passage. Then, the motor controller is operable to perform an in-timing retaining operation of retaining a rotated position of the stepping motor by supplying an energizing current of the first current value to the stepping motor at the timing when the lead end of the sheet enters the entrance of the guide passage. Thereby, the retention force of the stepping motor becomes larger than the detent torque of the stepping motor. This is advantageous in suppressing rotation of the rotary guide member by a rotation torque resulting from abutment of a sheet against the guide passage.

This application is based on Japanese Patent Application No. 2008-112693 filed on Apr. 23, 2008, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A sheet transport direction switching device, comprising:

a rotary guide member including a guide passage for passing a sheet to be transported, and pivotally movable about an axis of a support shaft extending in a direction orthogonal to a sheet transport direction to such a posture as to align an exit of the guide passage with at least one of two discharge destinations;

a stepping motor for changing the posture of the rotary guide member;

a motor controller for controlling a rotation of the stepping motor by supplying an energizing current through a coil to the stepping motor; and a lead end in-timing acquirer for acquiring a timing when a lead end of the sheet enters an entrance of the guide passage, wherein the motor controller is operable to perform, in a state that the exit of the guide passage is aligned with at least one of the two discharge destinations, an in-timing retaining operation of retaining a rotated position of the stepping motor by supplying an energizing current of a first current value to the stepping motor at the timing, acquired by the lead end in-timing acquirer, when the lead end of the sheet enters the entrance of the guide passage, and a pass timing retaining operation of reducing the energizing current to a second current value smaller than the first current value when the lead end of the sheet passes the guide passage.

2. The sheet transport direction switching device according to claim 1, further comprising a trail end out-timing acquirer for acquiring a timing when a trail end of the sheet exits the exit of the guide passage, wherein the motor controller is further operable to perform an out-timing retaining operation of retaining the rotated position of the stepping motor by supplying an energizing current of a third current value larger than the second current value to the stepping motor at the timing, acquired by the trail end out-timing acquirer, when the trail end of the sheet exits the exit of the guide passage in a state that the exit of the guide passage is aligned with at least one of the two discharge destinations.

3. The sheet transport direction switching device according to claim 2, wherein the third current value is smaller than the first current value.

4. The sheet transport direction switching device according to claim 2, further comprising an elasticity information acquirer for acquiring information relating to an elasticity of the sheet, as elasticity information, wherein the motor controller is operable to perform the in-timing retaining operation and the out-timing retaining operation, in the case where the elasticity information acquired by the elasticity information acquirer indicates an elasticity equal to or larger than a predetermined first elasticity, and the motor controller is operable to perform the in-timing retaining operation, and inoperable to perform the out-timing retaining operation, in the case where the elasticity information acquired by the elasticity information acquirer indicates an elasticity smaller than the first elasticity, and equal to or larger than a second elasticity smaller than the first elasticity.

5. The sheet transport direction switching device according to claim 4, wherein the elasticity information acquirer is operable to acquire sheet type information as to whether the sheet is an ordinary sheet, a thick sheet, or a resin sheet, as the elasticity information, and the elasticity of the resin sheet is defined as the first elasticity, and the elasticity of the thick sheet is defined as the second elasticity.

6. The sheet transport direction switching device according to claim 4, wherein the motor controller is inoperable to perform the in-timing retaining operation and the out-timing retaining operation, in the case where the elasticity information acquired by the elasticity information acquirer indicates an elasticity smaller than the second elasticity.

7. The sheet transport direction switching device according to claim 1, further comprising an elasticity information acquirer for acquiring information relating to an elasticity of the sheet, as elasticity information, wherein the motor controller is operable to perform the in-timing retaining operation, in the case where the elasticity information acquired by the elasticity information acquirer indicates an elasticity equal to or larger than a predetermined first elasticity.

8. The sheet transport direction switching device according to claim 7, wherein the elasticity information acquirer is operable to acquire sheet type information as to whether the sheet is an ordinary sheet or a thick sheet, as the elasticity information, and the elasticity of the thick sheet is defined as the first elasticity.

9. The sheet transport direction switching device according to claim 1, further comprising an elasticity information acquirer for acquiring information relating to an elasticity of the sheet, as elasticity information, and an energizing current setter for increasing the first current value, as the elasticity information acquired by the elasticity information acquirer indicates a larger elasticity.

10. An image forming apparatus comprising:

the sheet transport direction switching device of claim 1; and an image forming section for forming an image on the sheet based on predetermined image data.

11. The image forming apparatus according to claim 10, further comprising:

a trail end out-timing acquirer for acquiring a timing when a trail end of the sheet exits the exit of the guide passage, wherein the motor controller is further operable to perform an out-timing retaining operation of retaining the rotated position of the stepping motor by supplying an energizing current of a third current value larger than the second current value to the stepping motor at the timing, acquired by the trail end out-timing acquirer, when the trail end of the sheet exits the exit of the guide passage in a state that the exit of the guide passage is aligned with at least one of the two discharge destinations.

12. The image forming apparatus according to claim 11, wherein the third current value is smaller than the first current value.

13. The image forming apparatus according to claim 11, further comprising an elasticity information acquirer for acquiring information relating to an elasticity of the sheet, as elasticity information, wherein the motor controller is operable to perform the in-timing retaining operation and the out-timing retaining operation, in the case where the elasticity information acquired by the elasticity information acquirer indicates an elasticity equal to or larger than a predetermined first elasticity, and the motor controller is operable to perform the in-timing retaining operation, and inoperable to perform the out-timing retaining operation, in the case where the elasticity information acquired by the elasticity information acquirer indicates an elasticity smaller than the first elasticity, and equal to or larger than a second elasticity smaller than the first elasticity.

14. The image forming apparatus according to claim 13, wherein the motor controller is further inoperable to perform the in-timing retaining operation and the out-timing retaining operation, in the case where the elasticity information acquired by the elasticity information acquirer indicates an elasticity smaller than the second elasticity.

15. The image forming apparatus according to claim 13, wherein the elasticity information acquirer is operable to acquire sheet type information as to whether the sheet is an ordinary sheet, a thick sheet, or a resin sheet, as the elasticity information, and the elasticity of the resin sheet is defined as the first elasticity, and the elasticity of the thick sheet is defined as the second elasticity.

16. The image forming apparatus according to claim 10, further comprising an elasticity information acquirer for acquiring information relating to an elasticity of the sheet, as elasticity information, and an energizing current setter for increasing the first current value, as the elasticity information acquired by the elasticity information acquirer indicates a larger elasticity.

17. The image forming apparatus according to claim 10, further comprising an elasticity information acquirer for acquiring information relating to an elasticity of the sheet, as elasticity information, wherein the motor controller is operable to perform the in-timing retaining operation, in the case where the elasticity information acquired by the elasticity information acquirer indicates an elasticity equal to or larger than a predetermined first elasticity.

18. The image forming apparatus according to claim 17, wherein the elasticity information acquirer is operable to acquire sheet type information as to whether the sheet is an ordinary sheet or a thick sheet, as the elasticity information, and the elasticity of the thick sheet is defined as the first elasticity.

* * * * *